US007421935B2

(12) United States Patent
Ho et al.

(10) Patent No.: US 7,421,935 B2
(45) Date of Patent: Sep. 9, 2008

(54) BARREL LOCKING APPARATUS FOR A PAINTBALL GUN

(75) Inventors: Stephen Ho, Sugarland, TX (US); Kheng Phang, Sugarland, TX (US)

(73) Assignee: Avalon Advanced Products, Inc, Sugarland, TX (US)

( * ) Notice: Subject to any disclaimer, the term of this patent is extended or adjusted under 35 U.S.C. 154(b) by 4 days.

(21) Appl. No.: 11/672,496

(22) Filed: Feb. 7, 2007

(65) Prior Publication Data

US 2007/0193569 A1 Aug. 23, 2007

Related U.S. Application Data

(63) Continuation-in-part of application No. 11/483,257, filed on Jul. 7, 2006, which is a continuation-in-part of application No. 11/402,211, filed on Apr. 11, 2006, which is a continuation-in-part of application No. 11/157,131, filed on Jun. 20, 2005, which is a continuation-in-part of application No. 11/069,768, filed on Mar. 1, 2005, now Pat. No. 7,210,389, which is a continuation-in-part of application No. 10/862,005, filed on Jun. 4, 2004, now Pat. No. 7,021,303.

(51) Int. Cl.
*F41A 21/00* (2006.01)

(52) U.S. Cl. ..... 89/30; 124/80; 42/70.01

(58) Field of Classification Search ..... 89/30, 89/31; 124/80, 83; 42/96, 70.01, 70.11; 222/563; 220/326, 315
See application file for complete search history.

(56) References Cited

U.S. PATENT DOCUMENTS

| | | | | | |
|---|---|---|---|---|---|
| 184,335 | A * | 11/1876 | Calmus | 138/96 R |
| 1,223,156 | A * | 4/1917 | Du Bois | 220/315 |
| 3,354,569 | A * | 11/1967 | Kassabian | 42/96 |
| 3,437,231 | A * | 4/1969 | Carpenter, Jr. | 220/601 |
| 3,506,157 | A * | 4/1970 | Dukess | 222/94 |
| 4,534,088 | A * | 8/1985 | Ricke | 24/295 |
| 4,660,804 | A * | 4/1987 | Liu | 251/149.6 |
| 4,912,869 | A * | 4/1990 | Govett | 42/105 |
| 5,381,919 | A * | 1/1995 | Griffin et al. | 220/326 |
| 6,176,032 | B1 * | 1/2001 | Cohen et al. | 42/96 |
| 6,289,623 | B1 * | 9/2001 | Cohen et al. | 42/96 |
| 6,708,950 | B2 * | 3/2004 | Christensen et al. | 251/342 |
| 6,733,047 | B1 * | 5/2004 | Stieler | 285/319 |
| 6,786,516 | B2 * | 9/2004 | Cronley | 285/322 |
| 6,935,537 | B2 * | 8/2005 | Tellez | 222/168 |
| 6,973,863 | B1 * | 12/2005 | Jones | 89/14.2 |
| 7,044,505 | B2 * | 5/2006 | Takayanagi | 285/93 |
| 7,044,506 | B2 * | 5/2006 | Dong | 285/319 |
| 2004/0200840 | A1 * | 10/2004 | Oser et al. | 220/315 |
| 2006/0101697 | A1 * | 5/2006 | Bushnell | 42/76.01 |
| 2006/0185658 | A1 * | 8/2006 | Stevens | 124/80 |
| 2006/0277812 | A1 * | 12/2006 | Cole | 42/96 |
| 2007/0181114 | A1 * | 8/2007 | Tippmann et al. | 124/71 |
| 2007/0234624 | A1 * | 10/2007 | Brunn | 42/105 |

* cited by examiner

*Primary Examiner*—Michael J. Carone
*Assistant Examiner*—Stewart T Knox
(74) *Attorney, Agent, or Firm*—Robert W. Strozier

(57) ABSTRACT

Paintball or non-lethal gun or marker apparatuses are disclosed to prevent projectiles from being inadvertently discharged from a paintball or other non-lethal gun or markers.

5 Claims, 36 Drawing Sheets

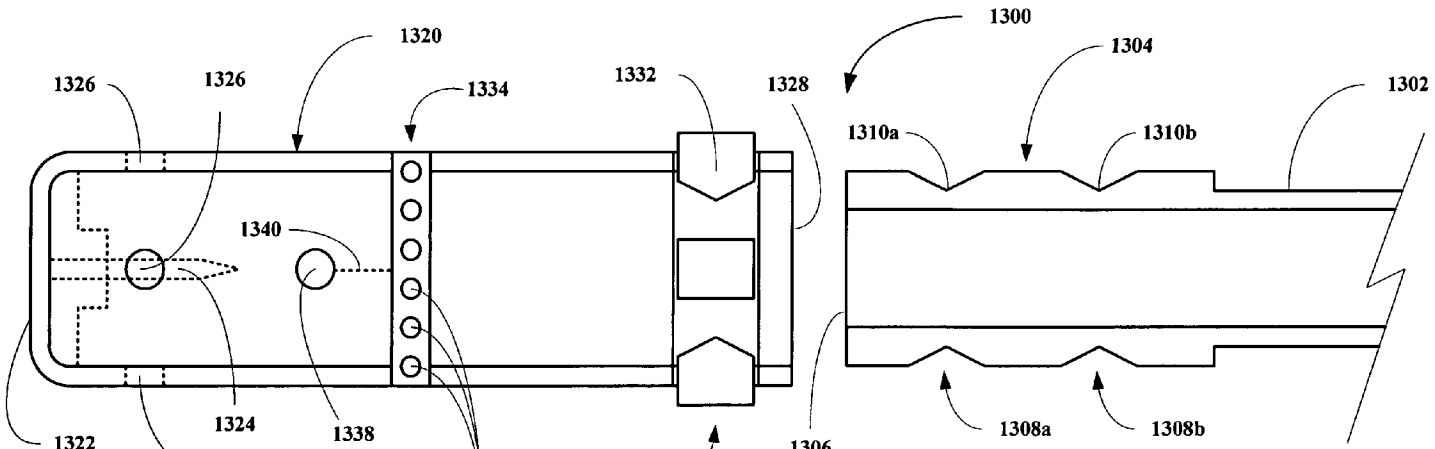
FIG. 13A
FIG. 13B
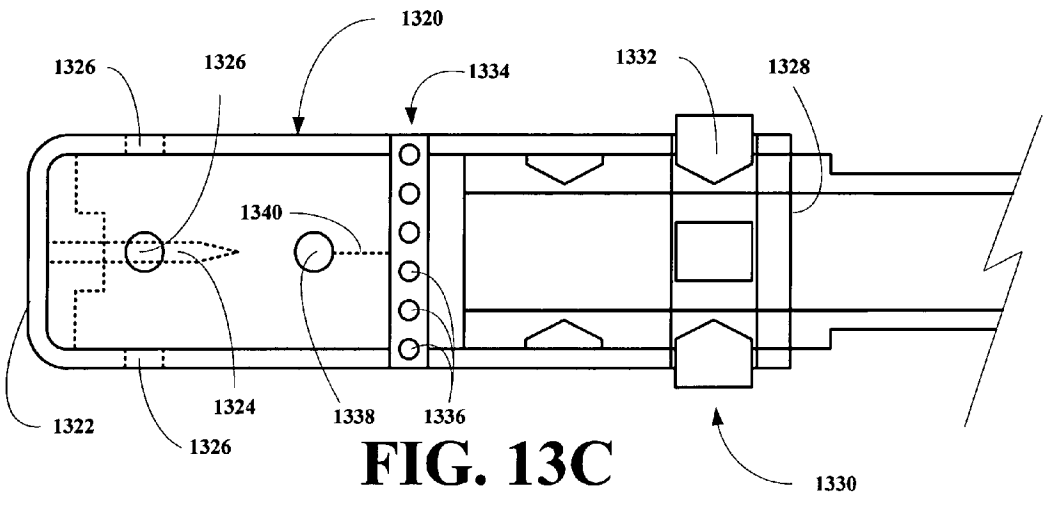
FIG. 13C

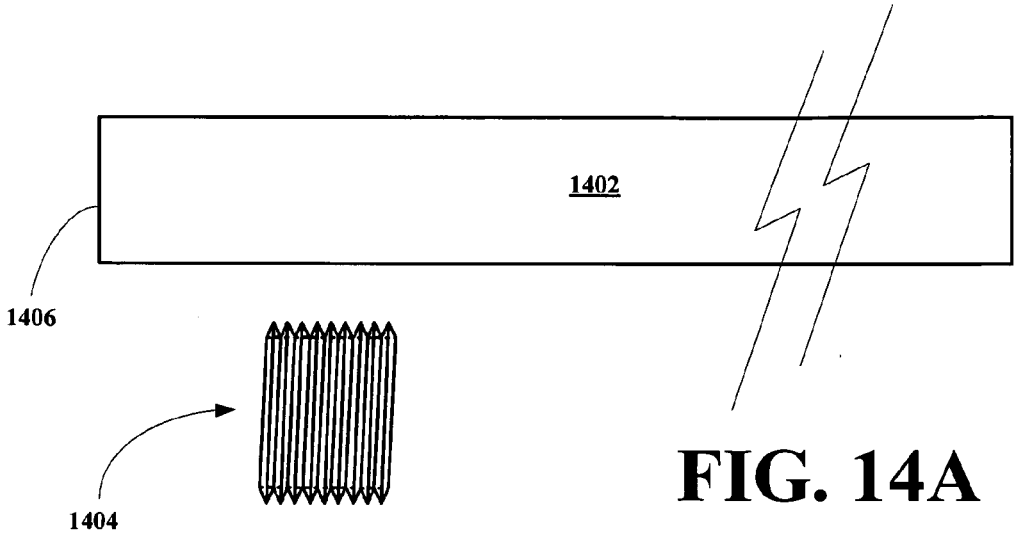
FIG. 14A
FIG. 14B
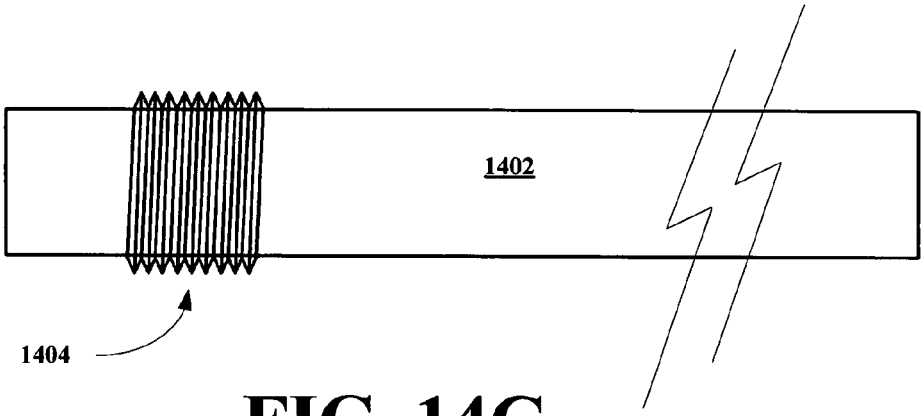
FIG. 14C
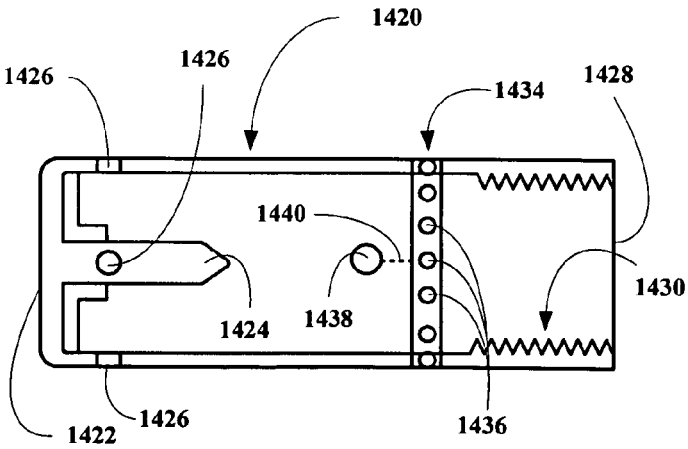
FIG. 14D

BARREL LOCKING APPARATUS FOR A PAINTBALL GUN

RELATED APPLICATIONS

This application is a continuation-in-part of U.S. patent application Ser. No. 11/483,257, filed Jul. 7, 2006, which is a continuation-in-part of U.S. patent application Ser. No. 11/402,211, filed Apr. 11, 2006, which is a continuation-in-part U.S. patent application Ser. No. 11/157,131, filed Jun. 20, 2005, which is a continuation-in-part of U.S. patent application Ser. No. 11/069,768, filed Mar. 1, 2005, now U.S. Pat. No. 7,210,389 which is a continuation-in-part of U.S. patent application Ser. No. 10/862,005, filed Jun. 4, 2004, now U.S. Pat. No. 7,021,303, issued Apr. 6, 2006, incorporated therein by reference.

BACKGROUND OF THE INVENTION

1. Field of the Invention

The present invention relates to a paintball or other non-lethal gun or marker barrel locking end cap apparatus.

More particularly, the present invention relates to a paintball or other non-lethal gun or marker barrel locking end cap apparatus, where the apparatus includes a hollow external barrel end engaging member and a cap having a paintball penetrator disposed within an interior of the cap and/or a vent for venting gas and/or paint. The present invention also includes a barrel blocking apparatus including a portion that is inserted into an end of the barrel including a paintball rupturing member or spike and optionally vents and via rotation of the top portion a set of pads in the inserted portion is pushed against the interior of the barrel to hold the apparatus in place. The apparatus is designed so that when an inadvertently discharged paintball impinges on the spike, the force increases the locking force against the barrel.

2. Description of the Related Art

Inadvertent firing or discharging of a paintball from a paintball gun or marker is a serious safety problem facing users, spectators and innocent bystanders. Although many barrel adaptors or condoms have been designed and introduced into the market, these devices are capable of being easily detached removing any protection that the devices afforded prior to detachment.

Thus, there is a need in the art for an improved barrel plug or condom for use with paintball or other non-lethal guns or markers to improve safety and lessen the chance of inadvertent detachment of the device.

SUMMARY OF THE INVENTION

The present invention provides a paintball gun or marker barrel locking end cap including an internal barrel portion comprising a cylindrical barrel plug insert having an inwardly extending paintball penetrating member disposed therein and one or a plurality of vents leading from an interior of the barrel to an exterior of the end cap. The vents are designed to exhaust any gases from an inadvertent firing or discharging of the gun or marker and to exhaust any paint from a paintball after the paintball has been punctured by the penetrating member. The end cap also includes an external portion comprising an outer barrel surface engaging assembly designed to surround an outer portion of the barrel near an end of the barrel, where the engaging assembly includes an outer barrel engaging and securing or locking member with a locking force that is sufficient to make removal with out loosening difficult. The outer barrel member of the engaging assembly is designed to engage the outer portion of the barrel with sufficient force that the end cap cannot be removed without reducing an engaging force by untightening the outer barrel member.

The present invention provides a paintball gun or marker barrel locking end cap including an outer barrel engaging and locking assemblage having a paintball penetrator disposed on an interior, distal surface of the assemblage and optionally a plurality of vents disposed at or near the distal end of the assemblage. The assemblage also includes a plurality of barrel engaging members or fingers and a threaded tightener sleeve adapted to tighten or loosen a locking force between the members and an outer surface of the barrel and optionally a stop adapted to stop the tightener at a certain position when fully untightened. Alternatively, the opened end of the assemblage can be slotted so that when the tightening sleeve is tightened in forces an inner surface of the opened end into frictional contact with an end of a barrel of a paintball gun. The tube or its members are designed to engage an outer surface of a paintball barrel with a locking force that is sufficient to make removal without loosening difficult to very difficult, where difficult means that a child or young adult would not have sufficient strength to remove the end cap and very difficult means that a normal adult would also be unable to remove the end cap.

The present invention provides a method for preventing inadvertent paintball discharges from a paintball gun or mark including the step of inserting an internal barrel portion of a locking barrel end cap into an end of a barrel of a paintball gun or marker, where the internal barrel portion comprises a cylindrical barrel plug insert having an inwardly extending paintball penetrating member disposed therein and one or a plurality of vents leading from an interior of the barrel to an exterior of the end cap. The vents are designed to exhaust any gases from an inadvertent firing or discharging of the gun or marker and to exhaust any paint from a paintball after the paintball has been punctured by the penetrating member. After inserting the internal portion into the barrel end, an external portion is tightened about a portion of the barrel near the barrel end with sufficient engaging force that the end cap cannot be removed unless the external portion is loosened or untightened, where the external portion comprises an outer barrel surface engaging member designed to surround an outer portion of the barrel near an end of the barrel. The external portion of the barrel end cap apparatus can be integral with, affixed to or detachably affixed to the internal portion of the barrel end cap.

The present invention also relates to a barrel engaging and locking apparatus for use with non-lethal propellant drive guns, which propel soft balls from a barrel, where the apparatus includes a member having a closed end and a threaded opened end. The apparatus also preferably includes one or a plurality of vents associated with or located near its closed end.

The present invention also relates to a barrel engaging and locking apparatus for use with non-lethal propellant drive guns, which propel soft balls from a barrel, where the apparatus includes two apertures in the barrel along its length, but preferably near its end and a blocking pin designed to be inserted into the apertures, where the pin stop any projectiles fired from the gun. Preferably, the pin has a tab on its proximal end making it easier to grab. The pin also preferably includes a locking member designed to prevent the pin from being dislodged from the apertures in the barrel. The apparatus can also include a mount mounted on the barrel for holding or securing the pin when it is not inserted through the apertures in the barrel. The apparatus can also include a retaining member attached at one end it to the proximal end of the pin and attached at its other end to the mount where the retaining member is designed to reduce the tendency of the pin to be lost.

The present invention also relates to a barrel engaging and locking apparatus for use with non-lethal propellant drive guns, which propel soft balls from a barrel, where the apparatus includes a slot in the barrel fitted with a pivoting flip tab that when flipped up blocks the barrel and when flipped down closes the slot. The apparatus also preferably includes a releasable locking member for holding the tab in its up position until the locking member is released.

The present invention also relates to a barrel engaging and locking apparatus for use with non-lethal propellant drive guns, which propel soft balls from a barrel, where the apparatus includes a slot in the barrel, an insertion disk, an insertion tab mount, and a retaining member attached to the insertion disk and the mount, where the disk is designed to be inserted in to the slot to block the barrel at the slot. The apparatus also preferably includes a releasable locking member associated with either the barrel or the disk to locks the tab in place until released.

The present invention also relates to a barrel engaging and locking apparatus for use with non-lethal propellant drive guns, which propel soft balls from a barrel, where the apparatus includes a diaphragm blocking device having a diaphragm and a turnable housing mounted into the barrel. The turnable housing is designed to open and close the diaphragm. The diaphragm is designed to open such that the diaphragm retracts into the housing clearing the barrel.

The present invention relates to barrels having a first connector at its proximal end adapted to detachably or permanently attached to a paintball gun and a second connector at its distal end adapted to detachably engage a connector of a barrel blocking apparatus so that inadvertently fired paintballs are destroyed within the blocking device causing no harm to people or animals.

The present invention also relates to barrel blocking assemblies including barrel blocking apparatus including a closed end having a spike extending outward from an inner surface of the closed end and adapted to rupture paintball impinging thereon. The barrel blocking apparatus also include a plurality of vents adapted to allow gases and liquid to escape from an interior of the apparatus. The apparatus also includes an open end and a connector at or near its open end adapted to detachably engage a corresponding connector at or near a distal end of a barrel of a paintball gun. The connector on the barrel blocking apparatus can be male or female, threaded or non-threaded provided of course that the paintball barrel have a corresponding connector. The barrel blocking apparatus can also includes one or a plurality of lights powered by a battery, where the lights can be used to indicate many different situation, such as a paintball player that is now out of a game, a gun that is properly affixed with a barrel blocking device, gun status, etc. The assembly can also include a mounting apparatus including two open ends and a connector adapted to detachably engage a corresponding connector at or near the distal end of the barrel. The mounting apparatus is fixedly or detachably attached to the barrel blocking apparatus. The mounting apparatus includes mounts for detachably attaching scope, lights, laser pointer, distant monitors or other paintball accessories to the mounting apparatus so that the accessories are located at the distal end of the barrel and are designed to improve gun aiming, improve target illumination, improve distance determination, etc.

New Disclosure

The present invention also relates to barrel blocking apparatus including a hollow barrel engaging member designed to be fitted onto an end of paintball gun. The barrel engaging member includes a locking assembly designed to detachably lock or attach the barrel engaging member to the barrel with sufficient force that the member cannot be removed without untightening the locking assembly attaching the member to the barrel, e.g., threads at an end of the barrel, threaded ring designed to force pads into direct contact with the barrel, or any other means for fastening the hollow member to the end of the barrel. The apparatus also includes a paintball blocking member adapted to be detachable connected to the hollow engaging member so that the paintball blocking member prevents paintballs from existing the blocking member if the gun is inadvertently discharged. The blocking member can include a penetrator disposed in inner end of the blocking member and adapted to rupture a paintball as it exists the barrel and the blocking member. The member can also include vents adapted to vent gas propelling the paintball as well as the paint from the paintball. In certain embodiments, the blocking member includes both a penetrator and at least one vent. In other embodiments, the inner end of the blocking member includes sharp raised bumps adapted to rupture the paintball on impact. In other embodiments, the blocking member includes only at least one vent. In other embodiments, the apparatus includes at least one light designed to signify that the barrel is blocked, the barrel is blocked and the player is no longer an active player in a game or exercise. In other embodiments, the lights are part of a separate end member that is detachably connected to a distal end of the blocking member. Thus, the apparatus can include two members or three member. The barrel engaging member is adapted to be attached to the end of the barrel and left there. The present also related to barrel made with the engaging member a permanent part of the barrel.

Most Recent Disclosure

DESCRIPTION OF THE DRAWINGS

The invention can be better understood with reference to the following detailed description together with the appended illustrative drawings in which like elements are numbered the same.

Figures for the Embodiment of the Parent

Figure for the Embodiment of the First CIP

Figure 5A:
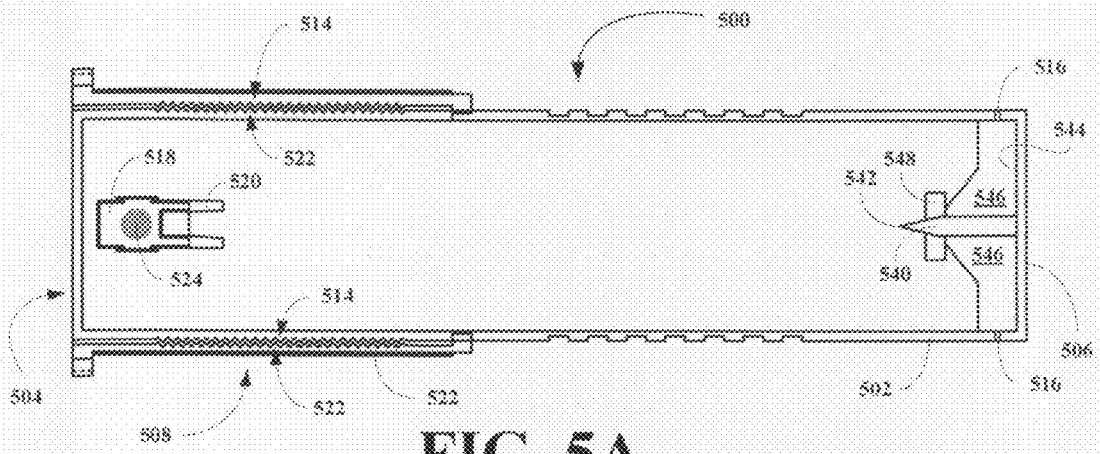
Figure 5B:
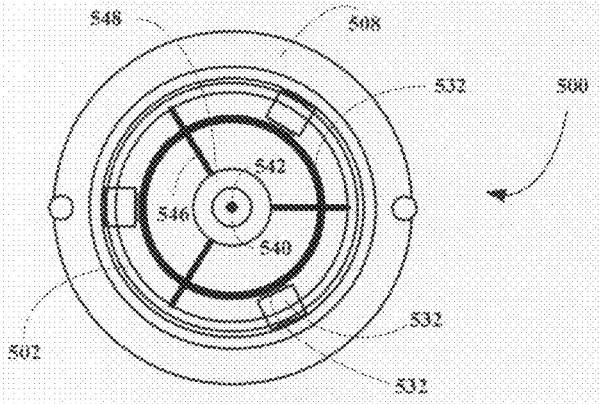
Figure 5C:
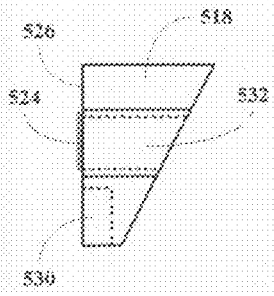
Figure 5D:
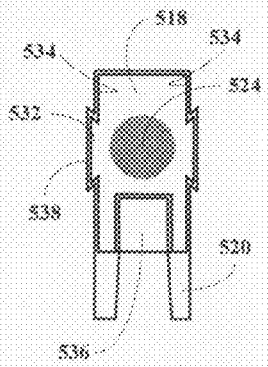
Figure 5E:
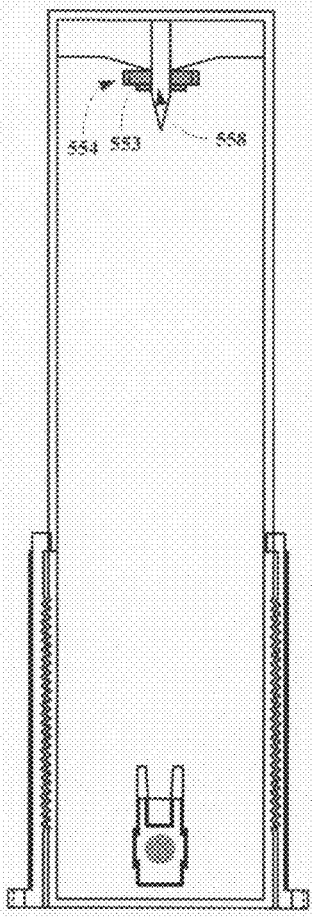
Figure 5G:
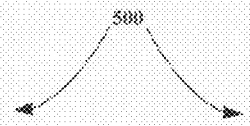
Figure 5G:
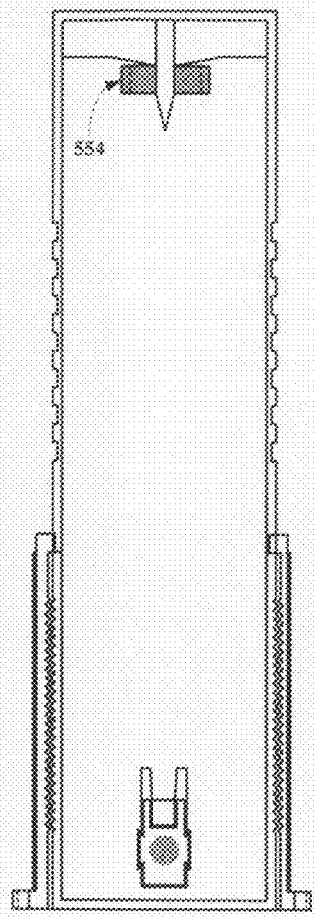
Figure 5F:
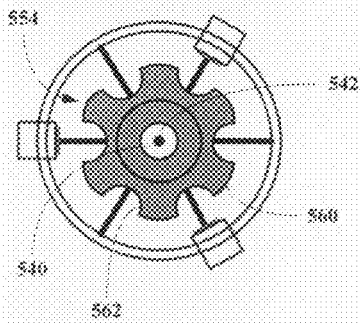
Figure 5H:
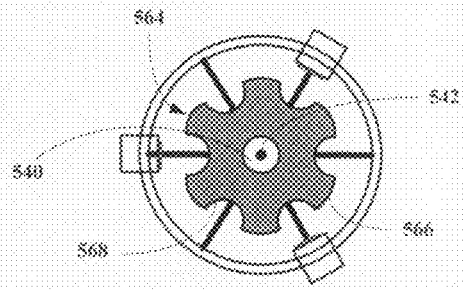

FIG. 5A depicts a cross-sectional view of a preferred embodiment of a outer barrel engaging and locking assemblage;

FIG. 5B depicts an end view of the assemblage of FIG. 5A;

FIG. 5C depicts a side view of an barrel engaging member of this invention,

FIG. 5D depicts a front view of the barrel engaging member of FIG. 5C mounted in its corresponding aperture;

FIG. 5E depicts a cross-section view of another embodiment of a outer barrel engaging and locking assemblage;

FIG. 5F depicts an end view of the tube of FIG. 5E;

FIG. 5G depicts a cross-section view of another embodiment of a outer barrel engaging and locking assemblage;

FIG. 5H depicts an end view of the tube of FIG. 5G;

Figures for the Embodiment of the Second CIP

Figure 6A:
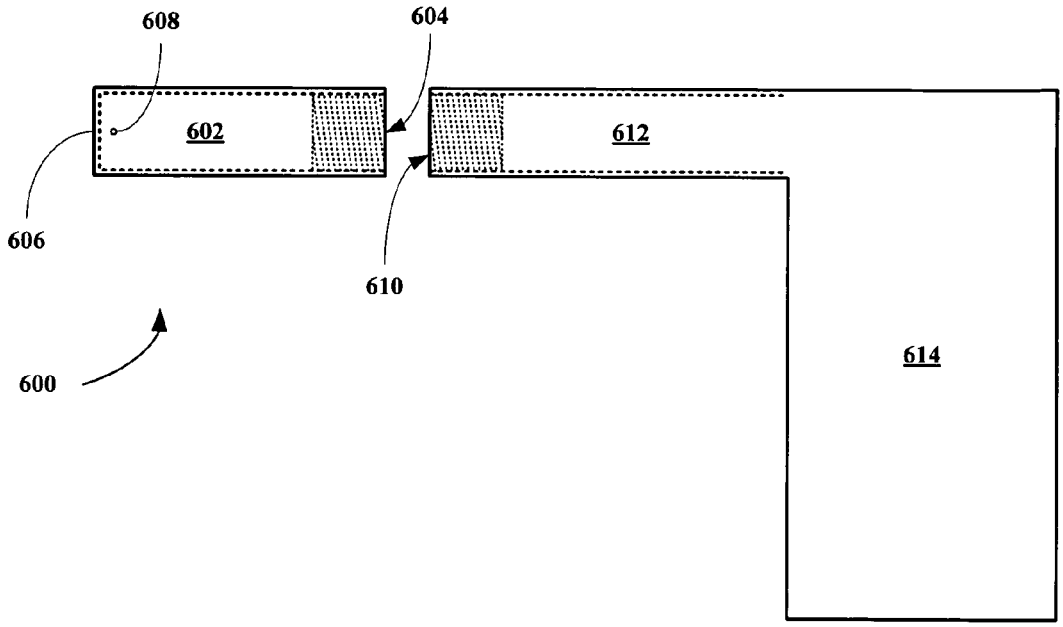

FIGS. 6A&B depict embodiments of a barrel blocking assembly including a barrel having a distal including a threaded connector and a barrel blocking apparatus including a threaded connector designed to engage the threaded connector of the barrel;

Figures for the Embodiment of the Third CIP

Figure 7A:
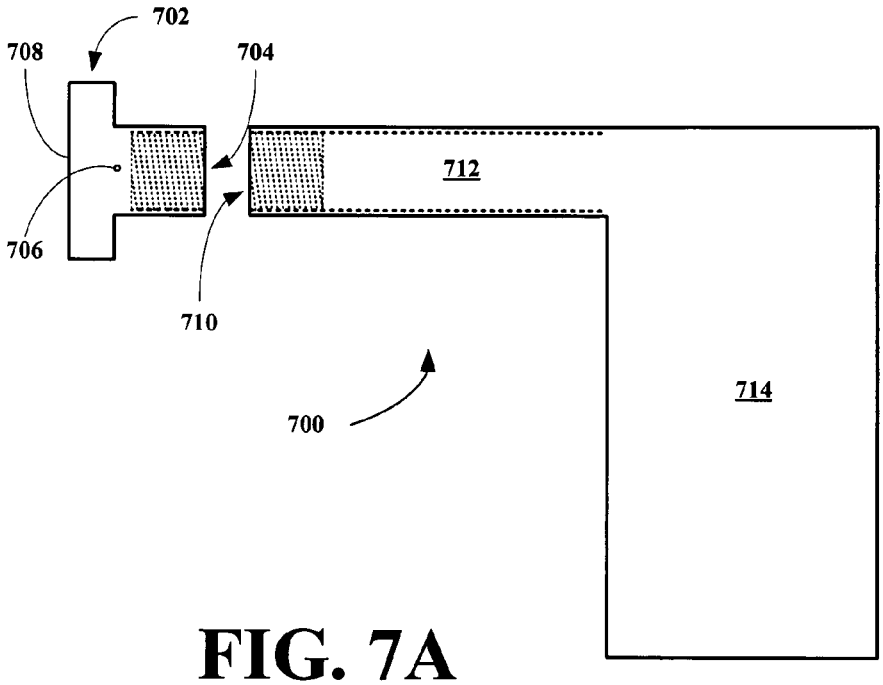
Figure 8:
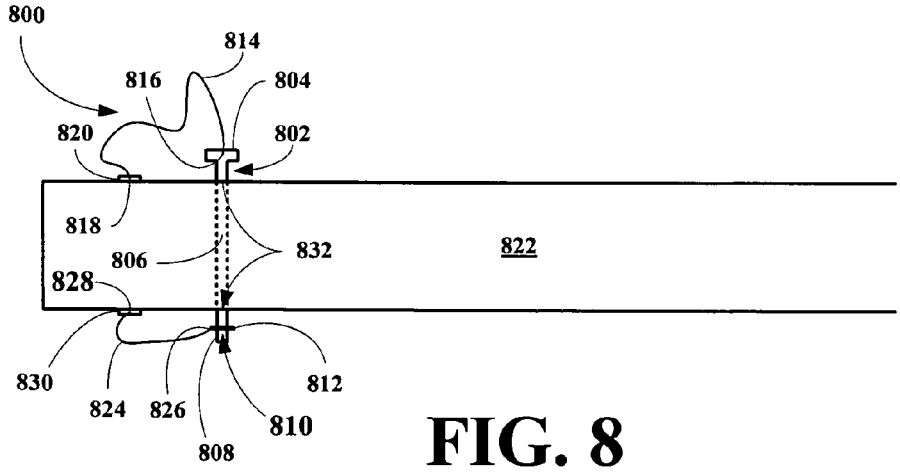
Figure 9A:
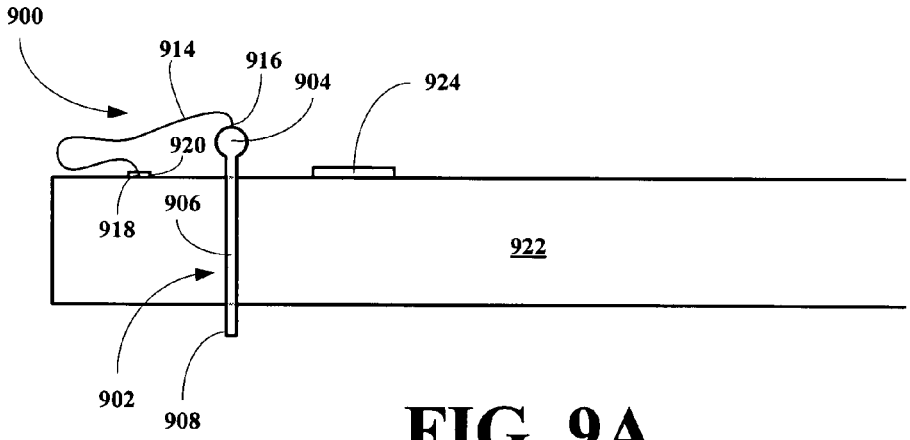
Figure 9B:
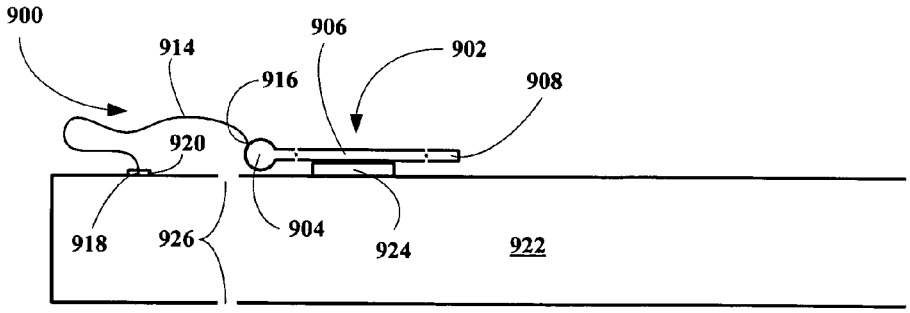
Figure 10A:
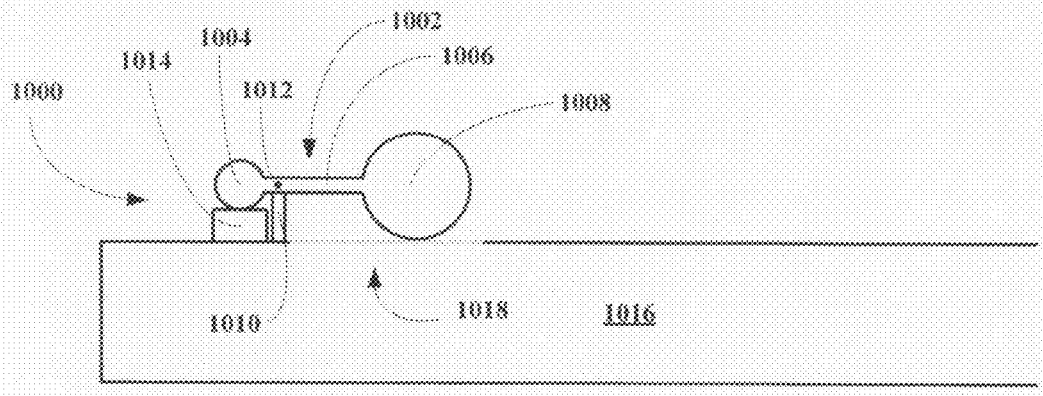
Figure 11A:
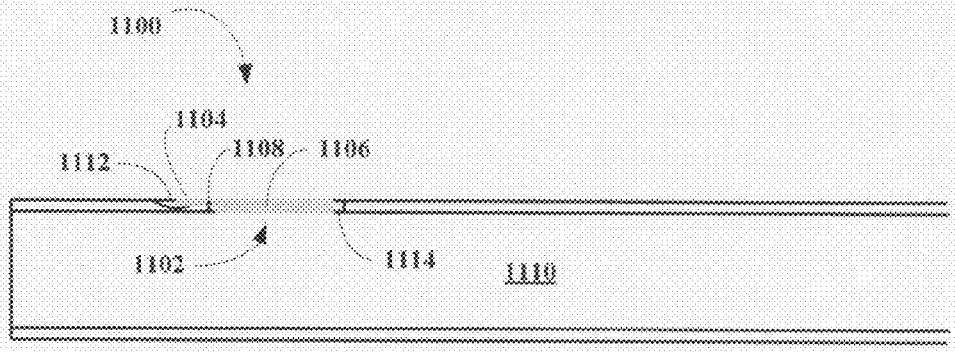

FIGS. 7A&B depict other embodiments of a barrel blocking assembly including a barrel having a distal including a threaded connector and a barrel blocking apparatus including a threaded connector designed to engage the threaded connector of the barrel;

FIG. 8 depicts an embodiment of a barrel blocking assembly including a barrel having first and second apertures disposed on opposite side of the barrel and a pin connected to the barrel by a tether and adapted to be inserted through the apertures;

FIGS. 9A&B depict embodiments of a barrel blocking assembly including a barrel having a distal including a threaded connector and a barrel blocking apparatus including a threaded connector designed to engage the threaded connector of the barrel;

FIGS. 10A&B depict embodiments of a barrel blocking assembly including a barrel having a distal including a threaded connector and a barrel blocking apparatus including a threaded connector designed to engage the threaded connector of the barrel;

FIGS. 11A&B depict embodiments of a barrel blocking assembly including a barrel having a distal including a threaded connector and a barrel blocking apparatus including a threaded connector designed to engage the threaded connector of the barrel;

Figures for the Embodiment of the Fourth CIP

Figure 12A:
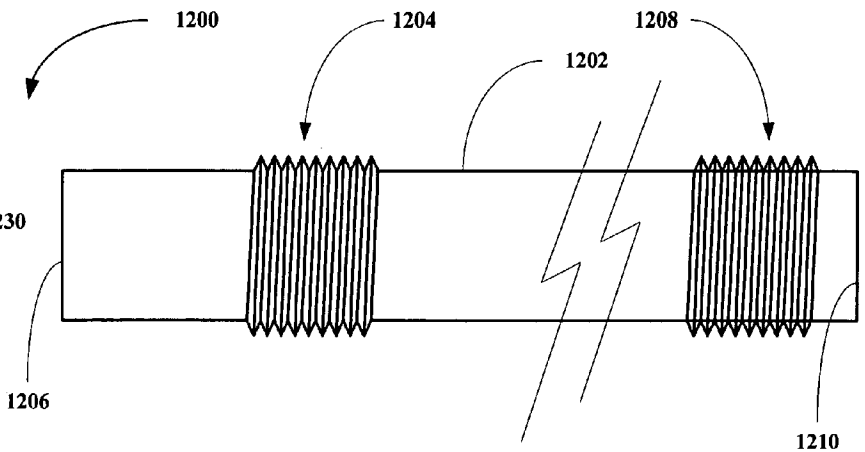
Figure 12B:
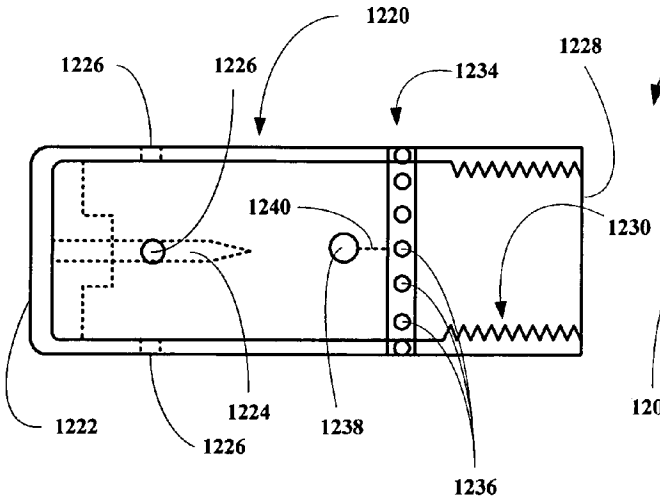
Figure 12C:
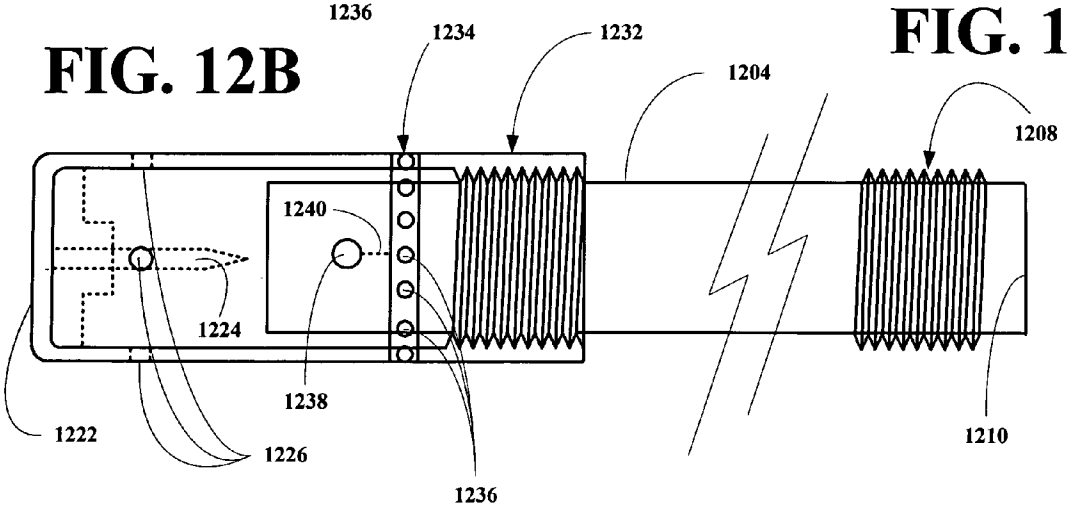
Figure 16A:
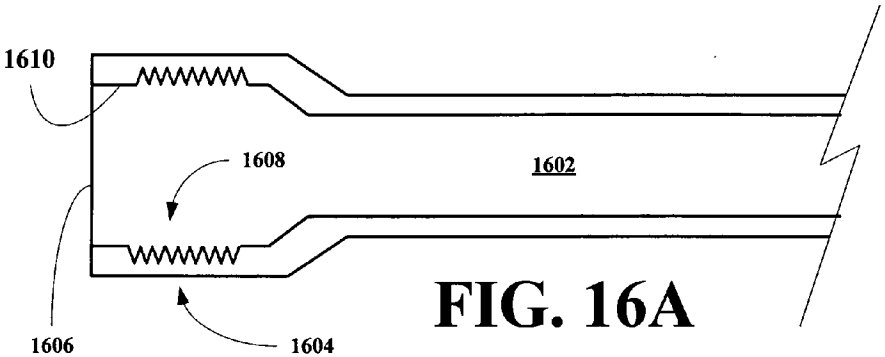
Figure 16B:
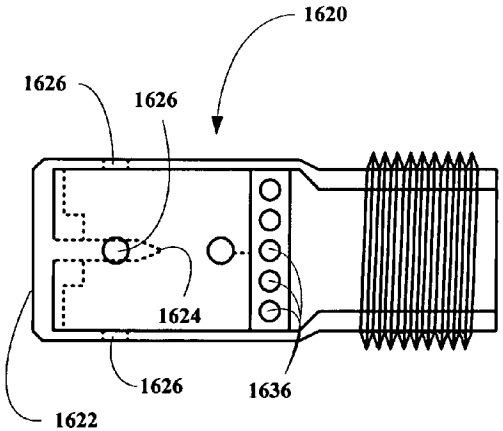
Figure 16C:
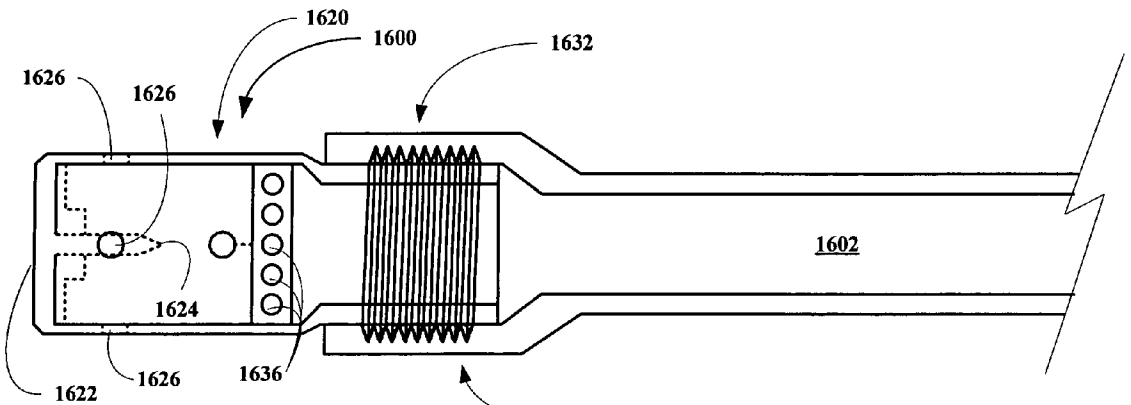
Figure 17A:
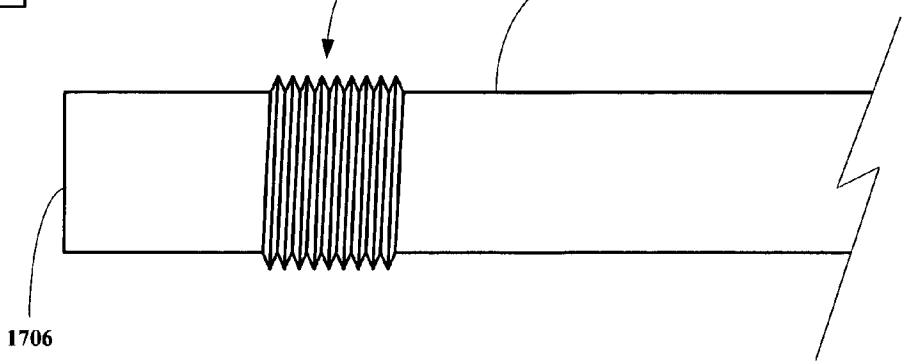
Figure 17B:
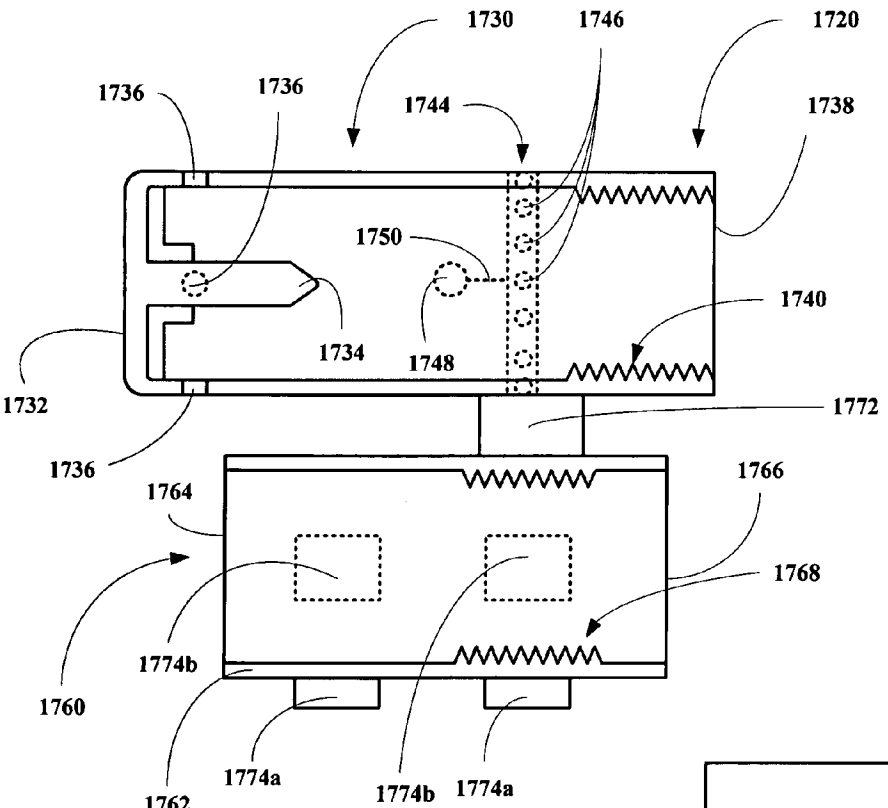
Figures 17C, 17D:
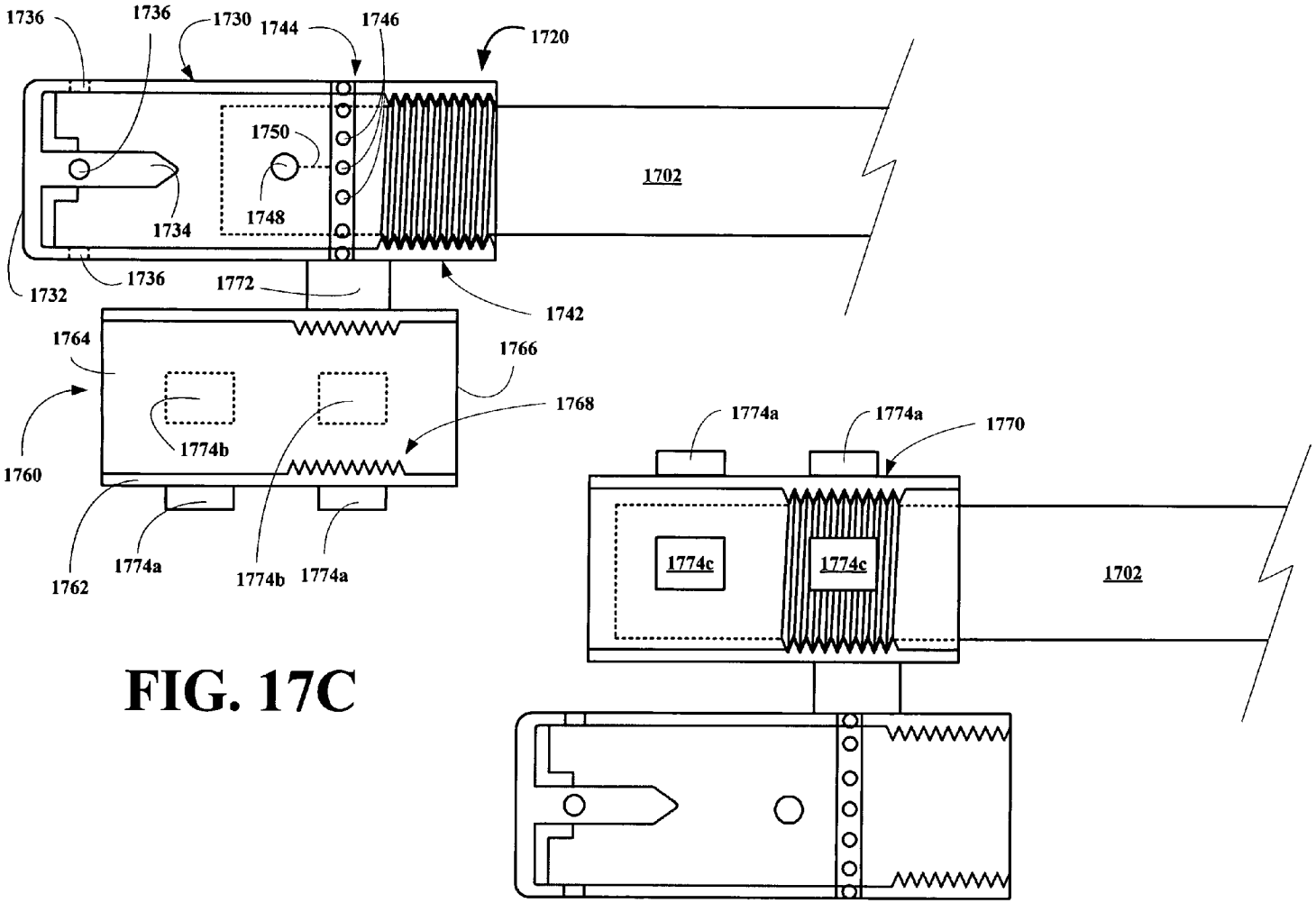
Figure 17F:
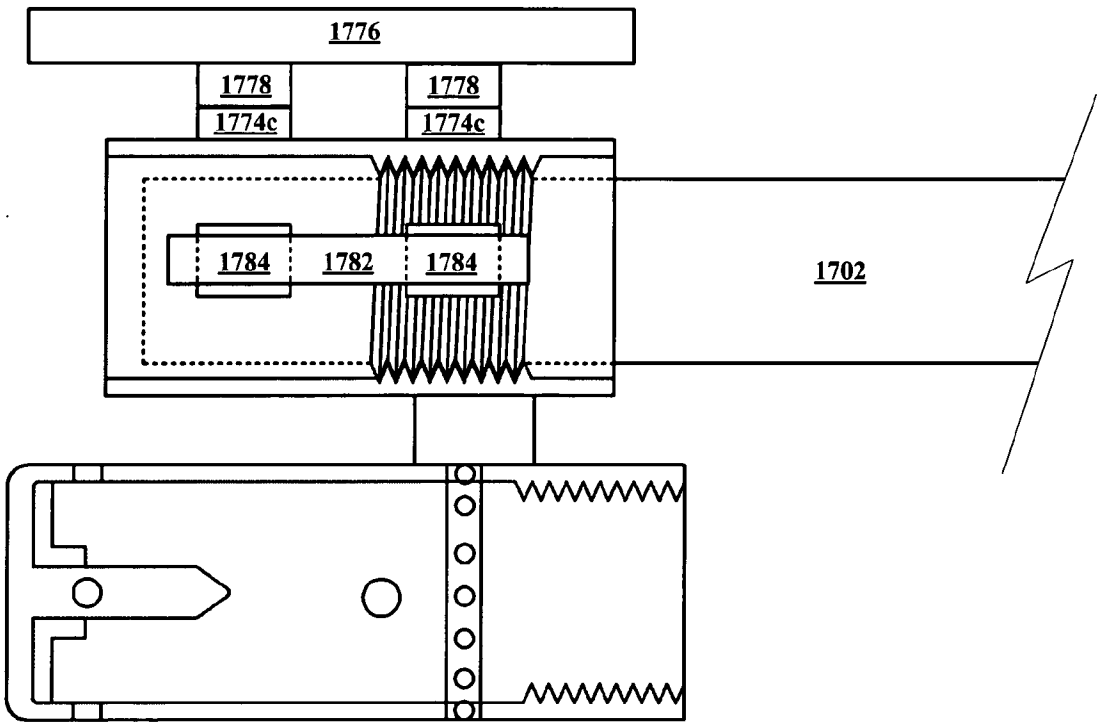
Figure 18A:
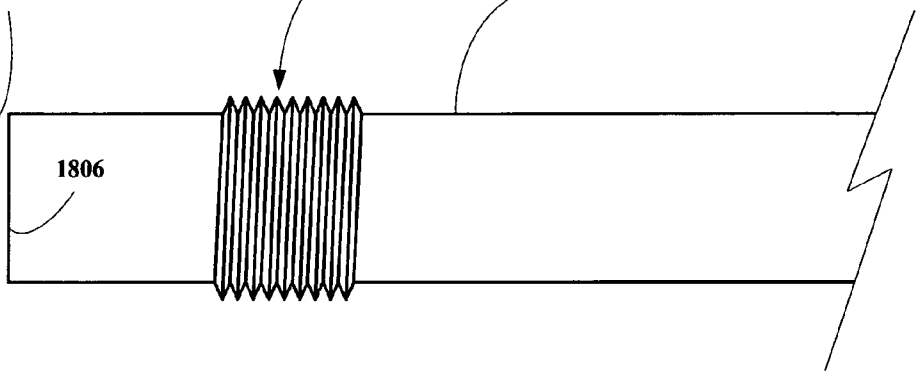
Figure 18B:
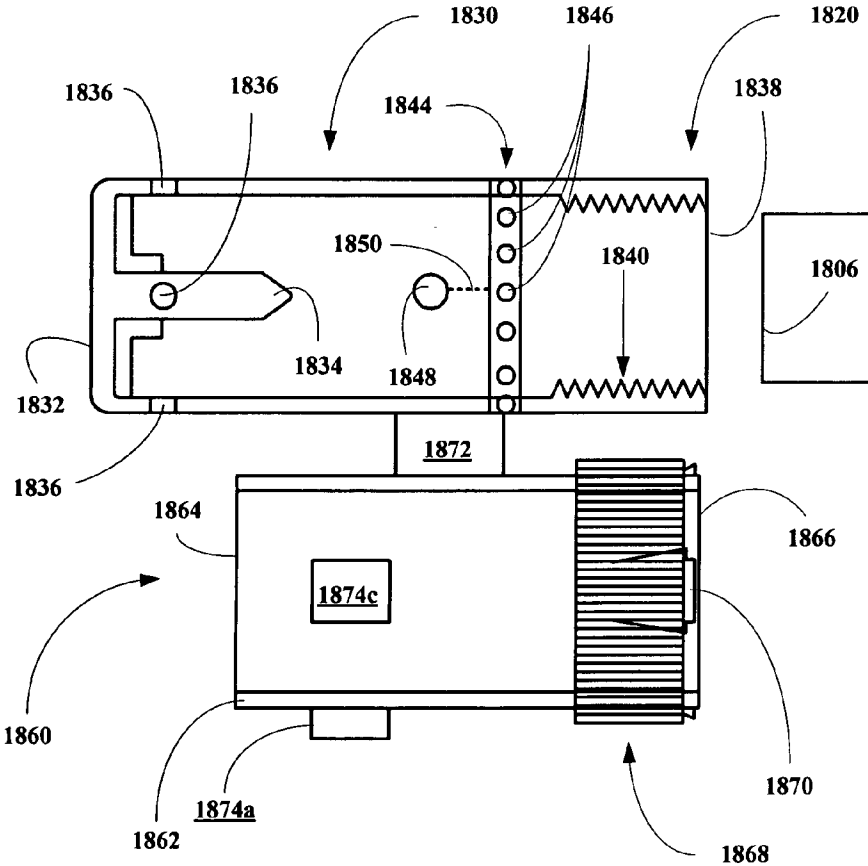
Figures 18C, 18D:
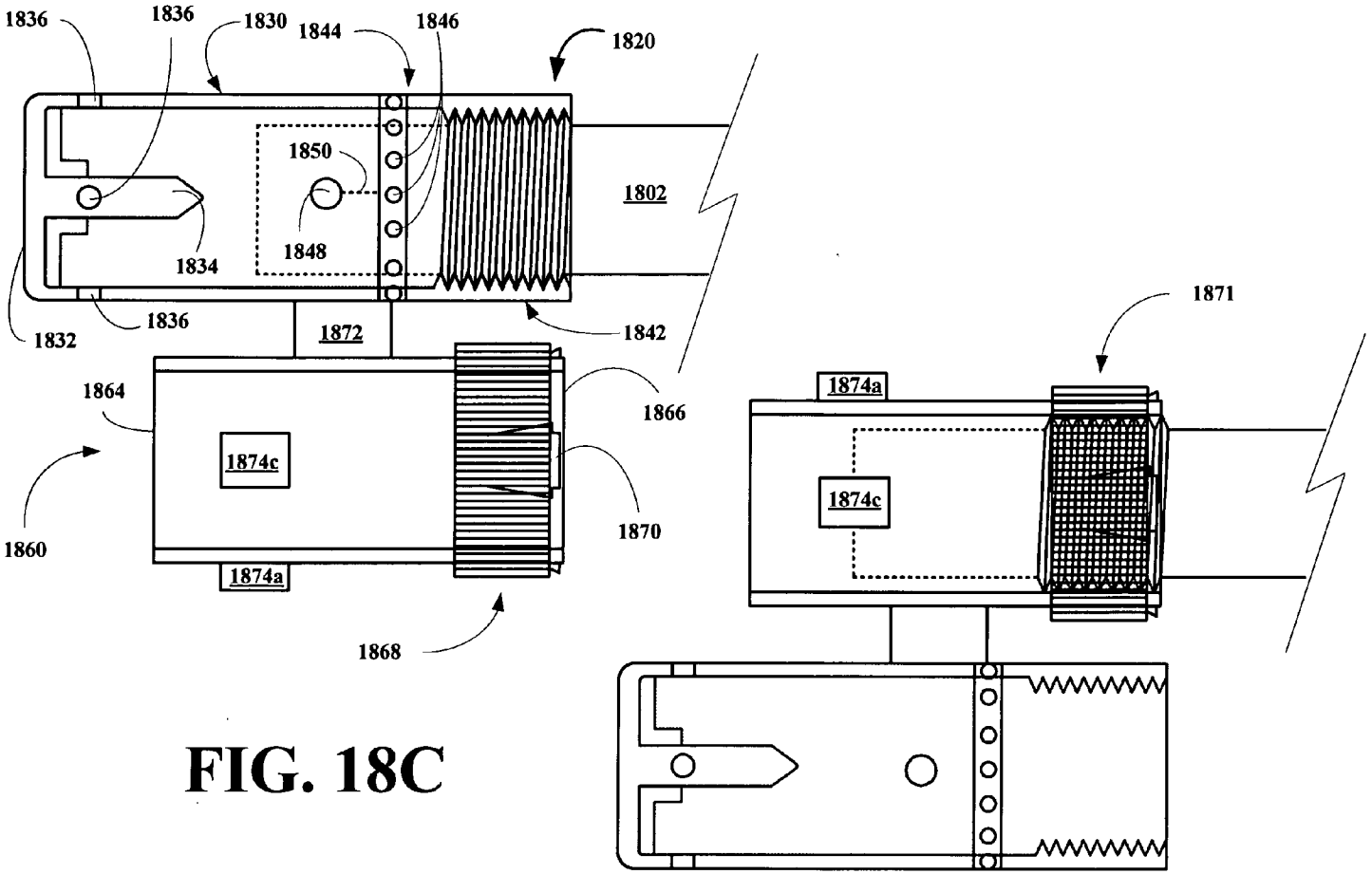
Figure 18E:
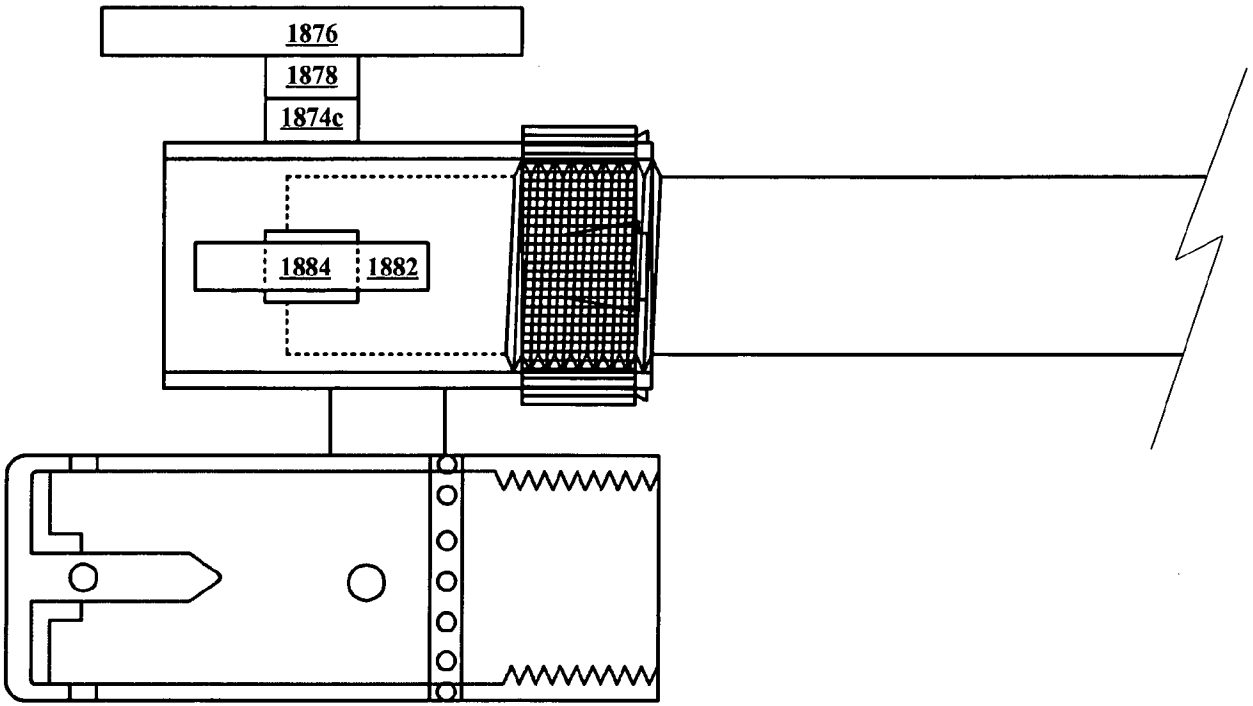

FIGS. 12A-C depict an embodiment of a barrel blocking assembly including a barrel including a male threaded connector and a barrel blocking apparatus including a female threaded connector;

FIGS. 13A-C depict embodiments of a barrel blocking assembly including a barrel having an enlarged distal end and a connector comprising a plurality of indentations and a barrel blocking apparatus including a plurality of spring loaded members for detachably engaging the barrel connector;

FIGS. 14A-E depict embodiments of a barrel blocking assembly including a barrel having a threaded connector ring adapted to be fitted onto a distal end of the barrel so that the barrel is equipped with a threaded connector and a barrel blocking apparatus including a threaded connector designed to engage the threaded connector of the barrel;

FIGS. 15A-D depict embodiments of a barrel blocking assembly including a barrel having a flared end and a female connector comprising an interior groove and a barrel blocking apparatus including a connector comprising a plurality of spring loaded member adapted to engage the groove of the barrel connector;

FIGS. 16A-C depict embodiments of a barrel blocking assembly including a barrel having a flared distal end and a female threaded section disposed on an interior of the flare and a barrel blocking apparatus including an external, male threaded section adapted to engage the barrel connector;

FIGS. 17A-C depict an embodiment of a barrel blocking assembly including a barrel including a male threaded connector and a multi-purpose barrel blocking apparatus including a barrel blocking apparatus including a female threaded connector and a mount assembly including a female threaded connector, FIGS. 18A-C depict an embodiment of a barrel blocking assembly including a barrel including a male threaded connector and a multi-purpose barrel blocking apparatus including a barrel blocking apparatus including a female threaded connector and a mount assembly including a non-threaded, female connector, FIGS. 19A-H depict several mounts for paintball accessories that can be mounted on the assembly of FIGS. 17 and 18;

Figures for Embodiments of the Fifth CIP

Figure 20B:
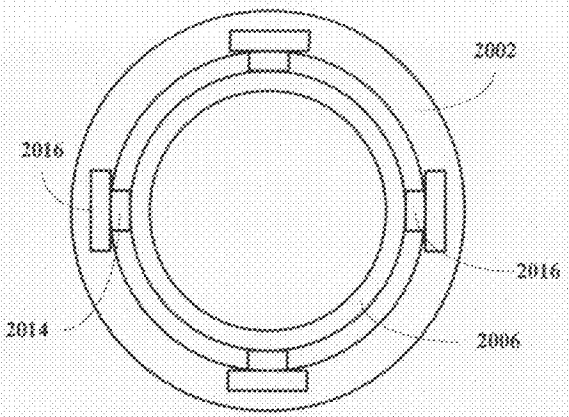
Figure 21B:
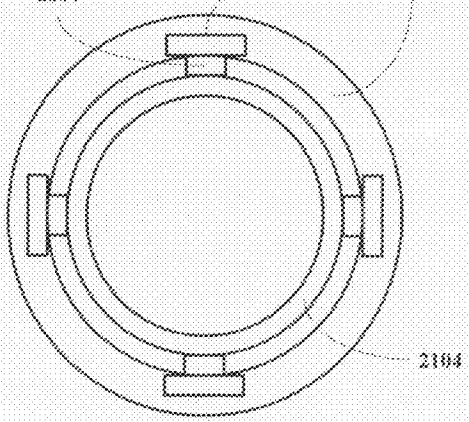
Figure 20A:
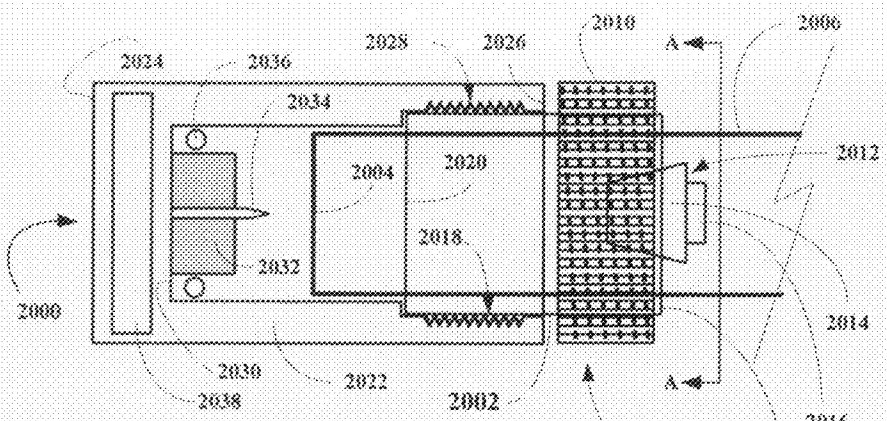
Figure 21A:
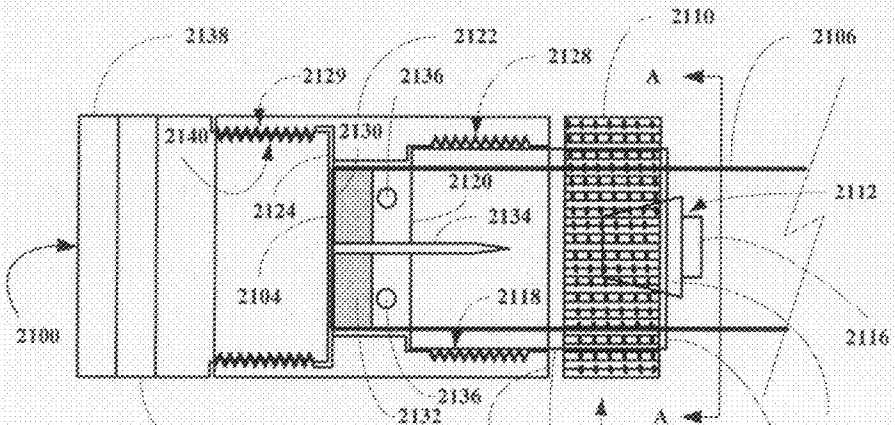
Figure 22A:
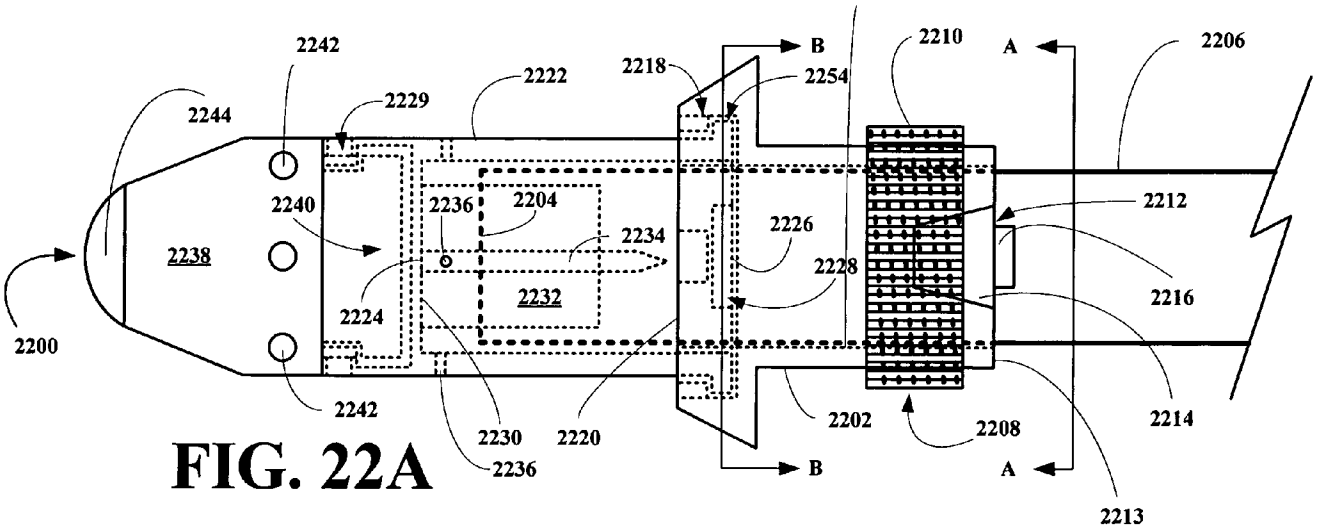
Figure 22B:
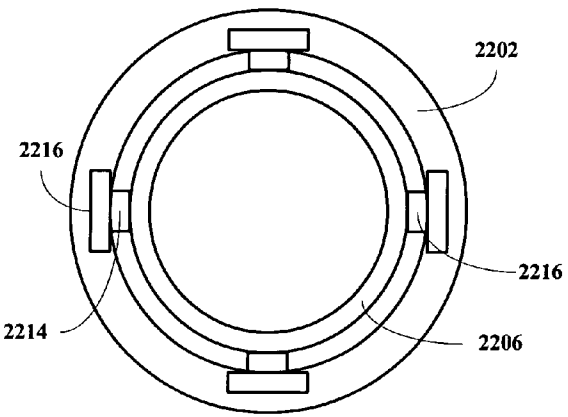
Figure 22C:
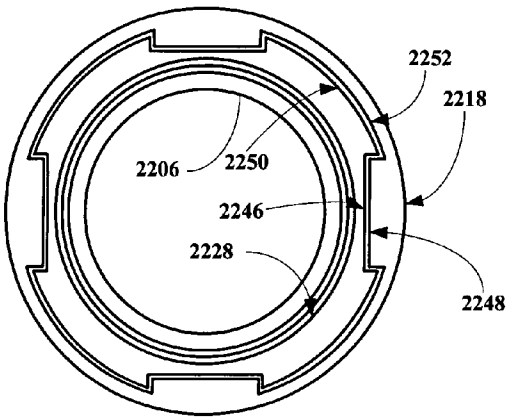
Figure 23A:
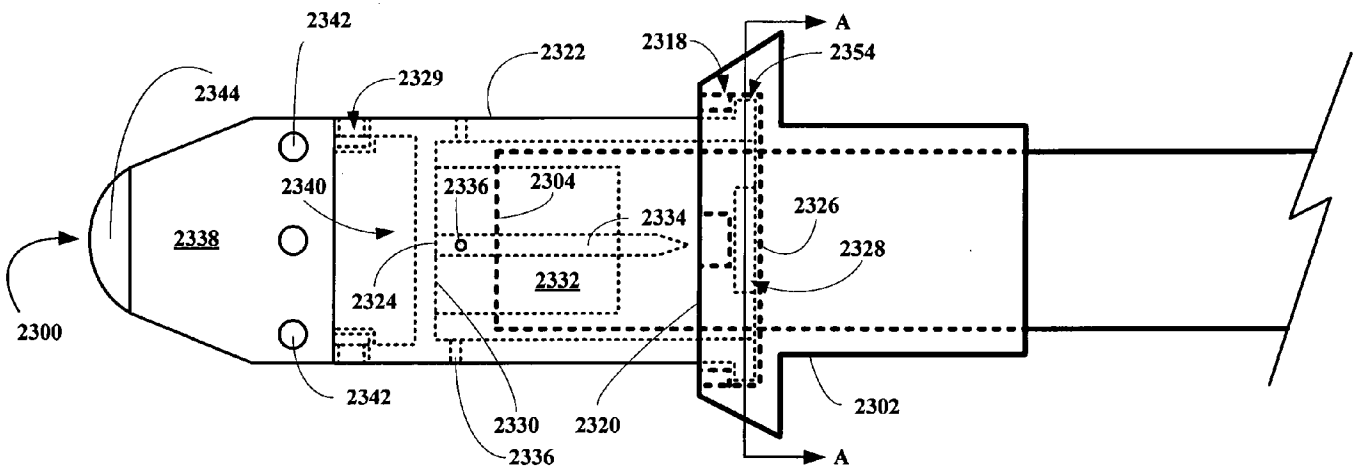
Figure 23B:
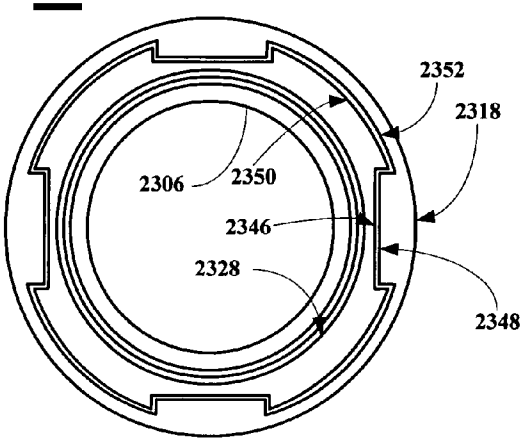
Figure 24A:
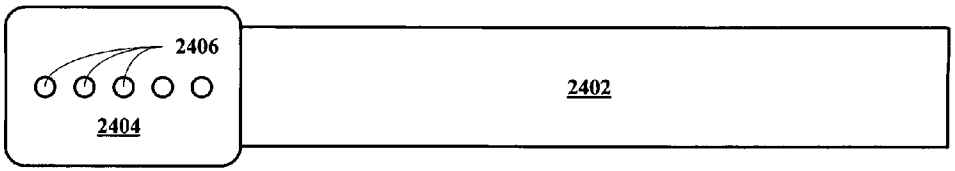
Figure 24B:
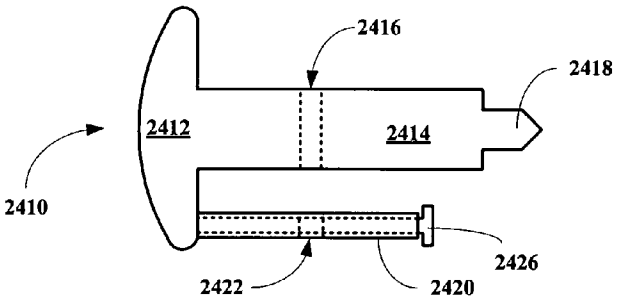
Figure 24C:
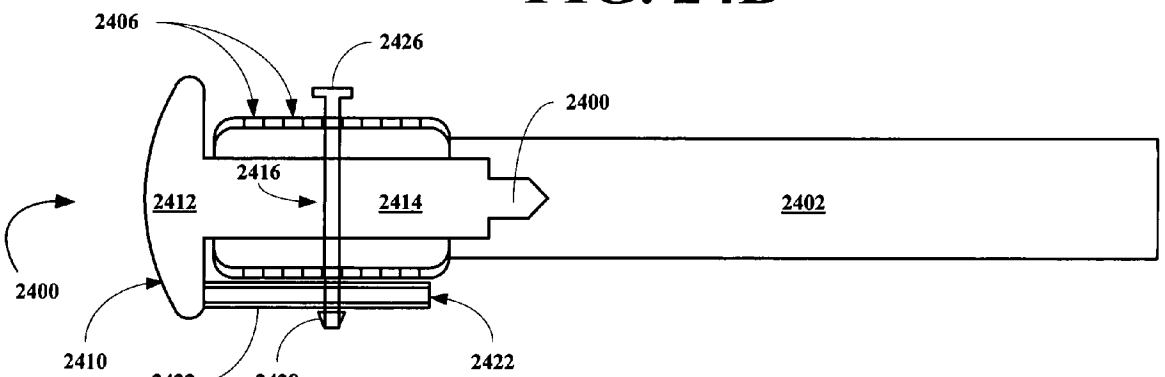

FIGS. 20A&B depict another embodiment of a barrel blocking apparatus including a barrel engaging member and a blocking member;

FIGS. 21A&B depict another embodiment of a barrel blocking apparatus including a barrel engaging member, a blocking member, and an end member;

FIGS. 22A, 22B and 22C depicts another embodiment of a barrel blocking apparatus including a barrel engaging member, a blocking member, and an end member;

FIGS. 23A and 23B depicts another embodiment of a barrel blocking apparatus including a barrel having a blocking member connector disposed at its distal end, a blocking member, and an end member; and FIGS. 24A, 24B and 24C depicts another embodiment of a barrel blocking apparatus including a barrel having a barrel blocking engaging member and a barrel plug.

Figures for Embodiments of the This CIP

FIGS. 25A-G depict another embodiment of a barrel blocking apparatus of this invention including an insertion portion and a surrounding portion, with or without a secondary locking assembly;

FIGS. 26A-D depict another embodiment of a barrel blocking apparatus of this invention including an insertion portion and a surrounding portion, with a secondary locking assembly; and FIGS. 27A-D depict another embodiment of a barrel blocking apparatus for use with a grooved barrel end.

DETAILED DESCRIPTION OF THE INVENTION

The inventors have found that a barrel end cap can be constructed that includes an internal portion having a paintball an inwardly extending penetration member and a plurality of aperture leading from the barrel interior to the exterior of the end cap. The end cap also includes an external part having a securing or locking assembly that is designed to engage an exterior surface of the barrel with sufficient force to prevent the cap from being inadvertently detaching from the barrel.

The present invention broadly relates to a paintball gun or marker locking end cap apparatus including an internal portion having a barrel insert including a paintball penetrating device extending from an interior of the insert towards a barrel end of the insert and one or a plurality of vents allowing materials to flow from an interior of the barrel to the surroundings. The penetrating device is designed to rupture any paintball inadvertently fired or discharged by the paintball gun or marker and the vent or vents are designed to exhaust any gases or paint from an inadvertent firing or discharging of the paintball gun or marker. The end cap apparatus also includes an external portion including a barrel engaging assembly, where the barrel engaging assembly is designed to engage an outer portion of the barrel near the barrel end with sufficient force so that the end cap cannot be removed without first untightening or unlocking the barrel engaging assembly.

Embodiments of This CIP

One new embodiments broadly relate to an internal barrel blocking apparatus that includes an oil ring or other similar frictional engaging ring for engaging an inner wall of a barrel of a non-legal gun or marker such as a paintball gun. The frictional engaging ring is disposed with in grooves in four prongs of a insertion portion of the barrel blocking apparatus, i.e., the portion of the apparatus that is inserted into the barrel. The four prongs are spaced apart with gaps therebetween and are supported by a non-rotatable outer portion of the apparatus. The barrel blocking apparatus also includes a central post that is flared at its distal end and mounted on a rotatable outer portion of the apparatus. The post may include a spike disposed in a center of the flared portion for assisting in the rupturing of inadvertently fired paintballs. Like all the barrel blocking apparatuses of this invention, these embodiments are designed to prevent a paintball leaving the barrel until the blocking apparatus has been removed. Additionally, the apparatus is designed to be able to withstand at least ten and up to hundreds of inadvertently discharged paintballs. The apparatus may also include vents designed to vent paint and gases that accompany an inadvertently fired paintball. The central post include four raised sections. These raised sections are designed to be positioned in the gaps between the prongs so that in the prongs are in a retracted state when the insertion portion of the apparatus is inserted into an end of the barrel. Once the insertion portion has been inserted into the end of the barrel, the rotatable outer portion of the apparatus is rotated about a quarter turn, which forces the raised section of the central post to contract inner surfaces of the prongs forcing the prongs outward, which in turn compresses the friction ring against the inner surface of the barrel locking the apparatus in place. Because the center post is flared at its distal end and have raised section that lock the frictional ring against the inner surface of the barrel, when a paintball is inadvertently discharged, the force of the paintball striking the central post actually increases the locking force of the friction ring against the barrel. For barrels having apertures therein at its discharge end, the apparatus may also include a spring loaded pin that when the insertion portion of the apparatus has been inserted into the barrel, then the user can rotate the entire apparatus until the spring loaded pin inserts into one of the barrel aperture providing a second level of locking of the apparatus to the barrel. The spring load pin includes a retractable cap that permits withdrawal of the pin from the barrel aperture so that the apparatus can be removed before or after the rotatable portion has been rotated to unlock the pressure on the friction ring.

Another new barrel blocking embodiment is designed to work with a barrel having a series of groove near is discharge end. The barrel may also be tapered after the last groove. The blocking apparatus includes a top potion having a plurality of downwardly extending spaced apart prongs having raised portions disposed on their inner surface adapted to insert into the groove in the barrel end. The top may also include a spike disposed in a center of the top portion on its inner surface to assist in rupturing inadvertently fired paintballs. The top may also include vents designed to vent paint and gases that accompany an inadvertently fired paintball. The apparatus also includes a rotatable outer ring having a plurality of protrusions disposed along its inner surface so that the protrusion fit in between the prongs when the apparatus is in its unlocked state. By rotating the outer ring relate to the top portion of the apparatus, the protrusions engage outer surfaces of the prongs forcing the raised portions of the prongs to insert into the groove in the barrel locking the apparatus in place.

Referring now to FIGS. 1A-D, an embodiment of a paintball gun end cap apparatus, generally 100, is shown to include an internal portion 110 and an external portion 150. The internal portion 110 includes a cylindrical barrel plug insert 112 having a paintball penetrating member 114 comprising an inwardly pointing spike 116 having a pointed tip 118 and a plurality of vents 120. The penetrating member 114 is designed to rupture any paintball inadvertently fired or discharged from a paint ball gun (not shown) as it travels down a barrel 122 toward the penetrating member 114. The vents 120 are designed to exhaust any gases or fluid generated from an inadvertent firing or discharging of a paintball and rupturing of the paintball as it encounters the penetrating member 114.

The external portion 150 includes cap portion 152 and a cylindrical outer barrel engaging portion 154 including two opposing slits 156 and a tightening assembly 158 associated with each slit 156. The assembly 158 is designed to generate a sufficient engaging force against a portion 160 of the barrel 122 so that the apparatus cannot be removed without untightening the assembly 158. The tightening assembly 158 includes a base 162, a guide block 164, a threaded block 166 and a threaded wing nut 168, where the wing nut 168 (or any other threaded bolt that can be tightened using a user's finger) is inserted through an aperture 170 in the guide block 162 and into a threaded aperture 172 in the threaded block 166 so that by screwing the wing nut 168 into the threaded aperture 172, the slit 156 is narrowed or closed generating the engaging force. Additionally, the barrel 122 can include a groove (not shown) into which a tab (not shown) on the inside of the outer barrel engaging portion 154 fits to further secure the apparatus 100 to the barrel 122. The apparatus 100 also includes straps 174 and strap blocks 176 affixed to the cap portion 152, where the straps 174 are designed to prevent the end cap apparatus 100 from being lost from the gun when not in use. The straps 174 generally are tied to the gun at their other ends.

Figure 1A:
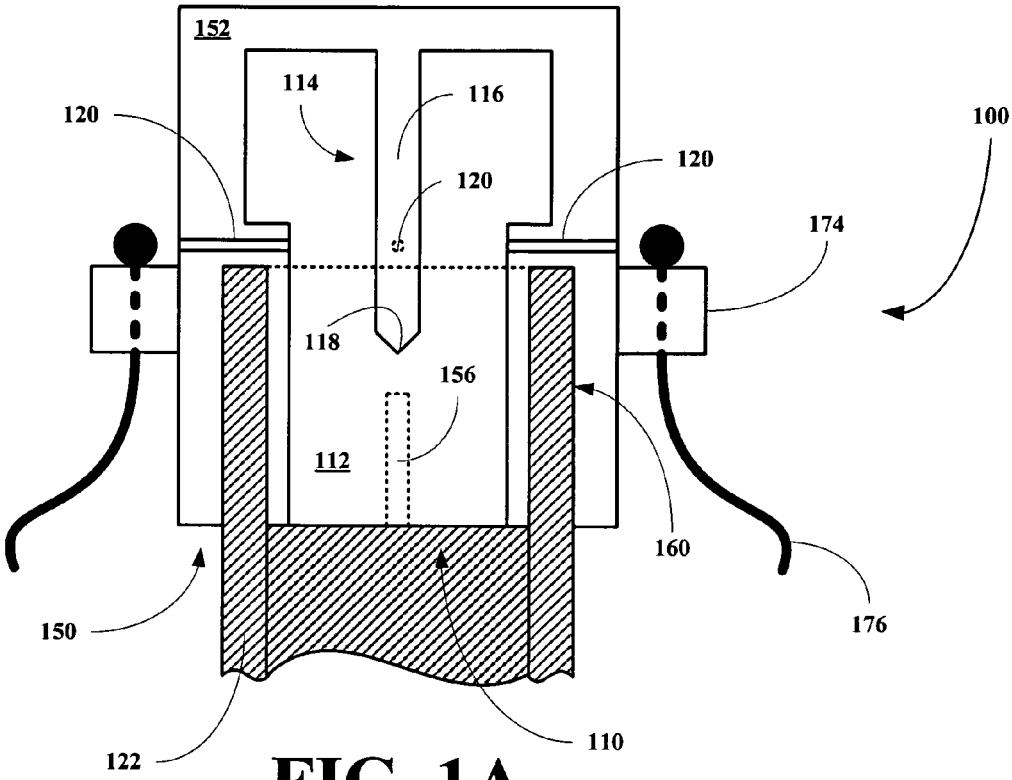
FIGS. 1A-D depict an embodiment of a locking barrel end cap for a paintball gun in cross-sectional, plan and top views, respectively.
Figure 1B:
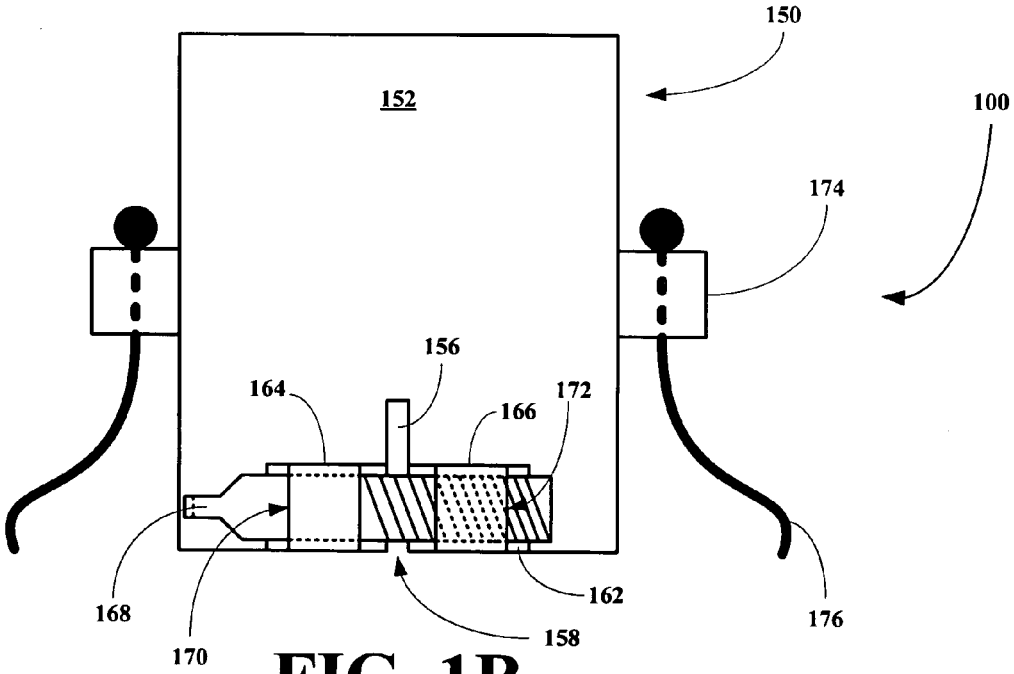
Figure 1C:
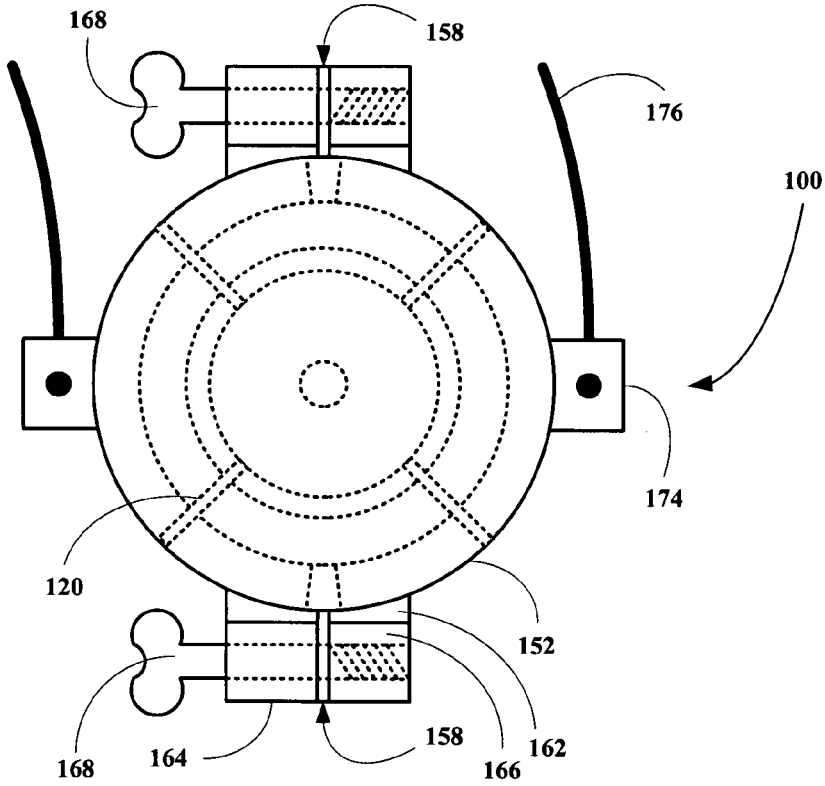
Figure 1D:
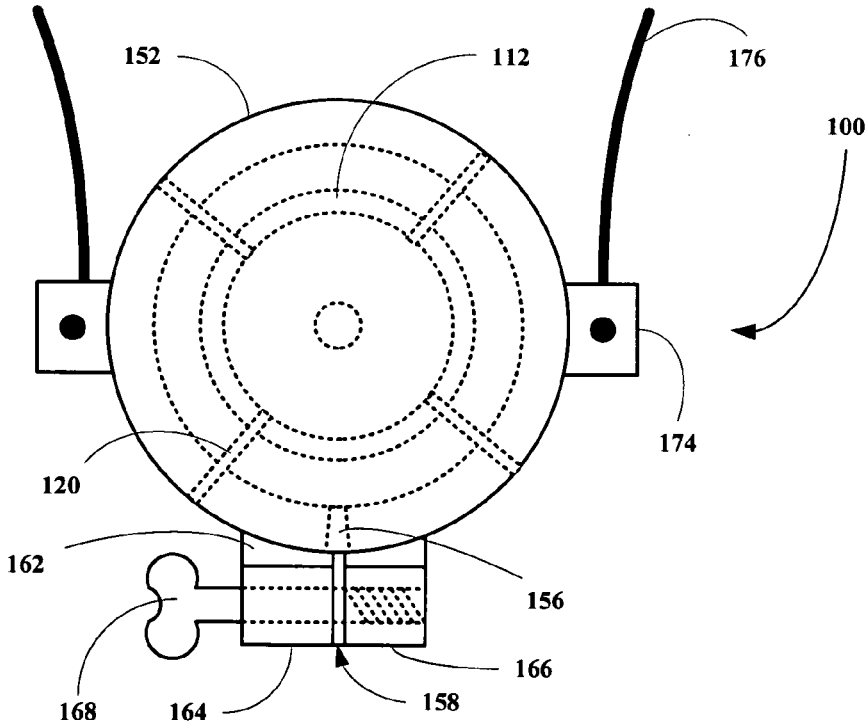

Looking at FIG. 1C, the apparatus 100 includes two opposing slits 156 having associated tightening assemblies 158, one for each slit 156. Looking at FIG. 1D, the apparatus 100 includes a single slit 156 having an associated tightening assembly 158.

Figure 2A:
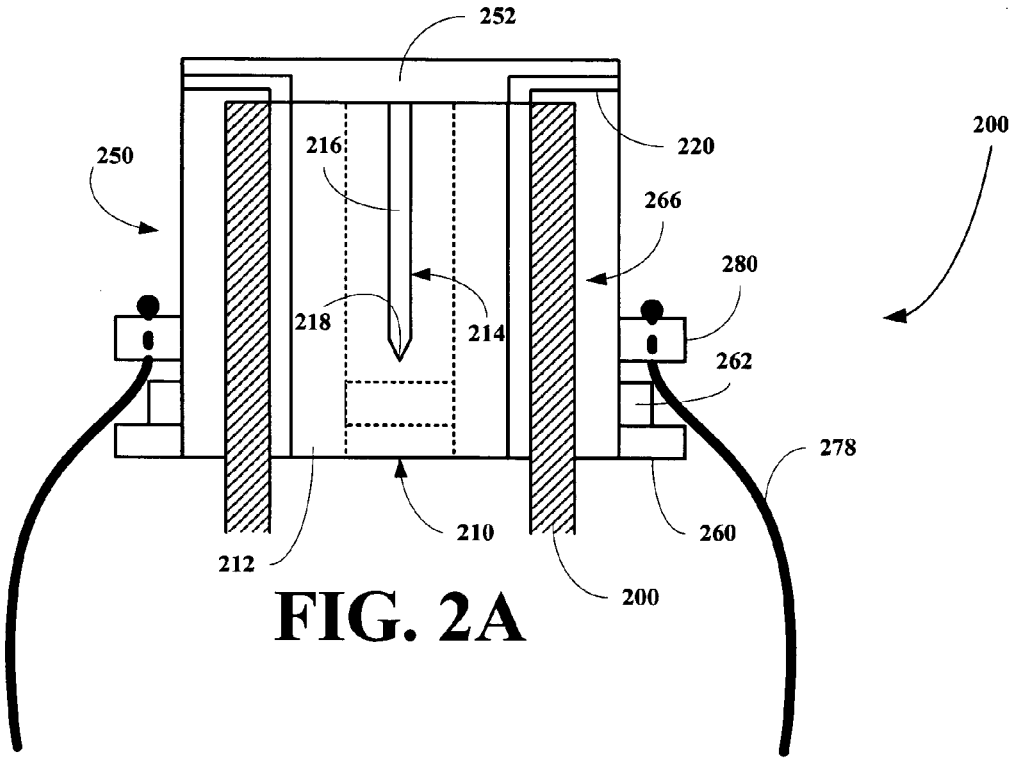
FIGS. 2A-D depict another embodiment of a locking barrel end cap for a paintball gun in cross-sectional, side and top views, respectively and an expanded view of an engaging ring.
Figure 2B:
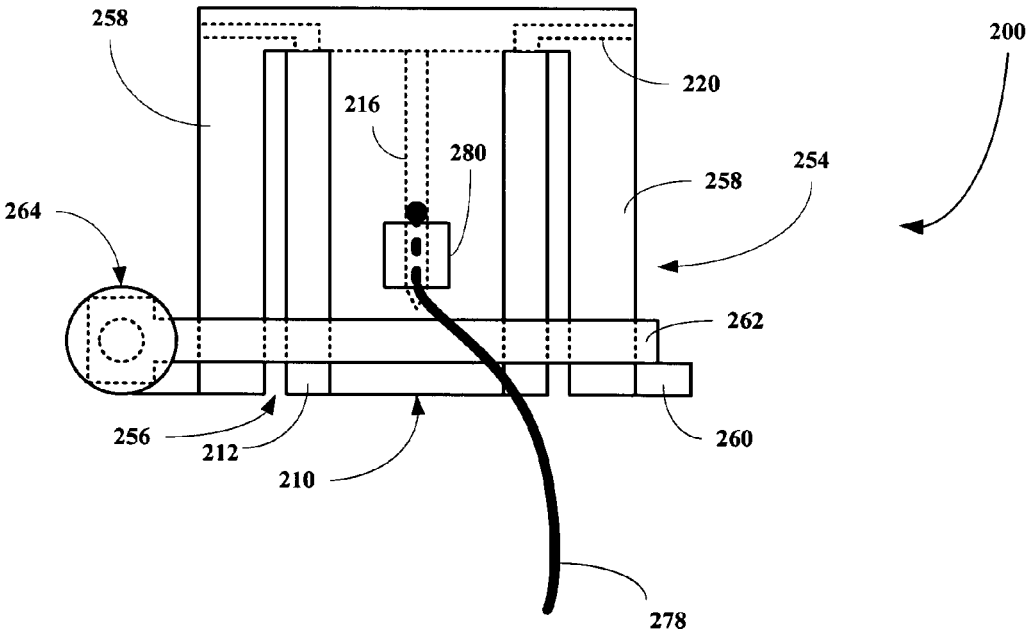
Figure 2C:
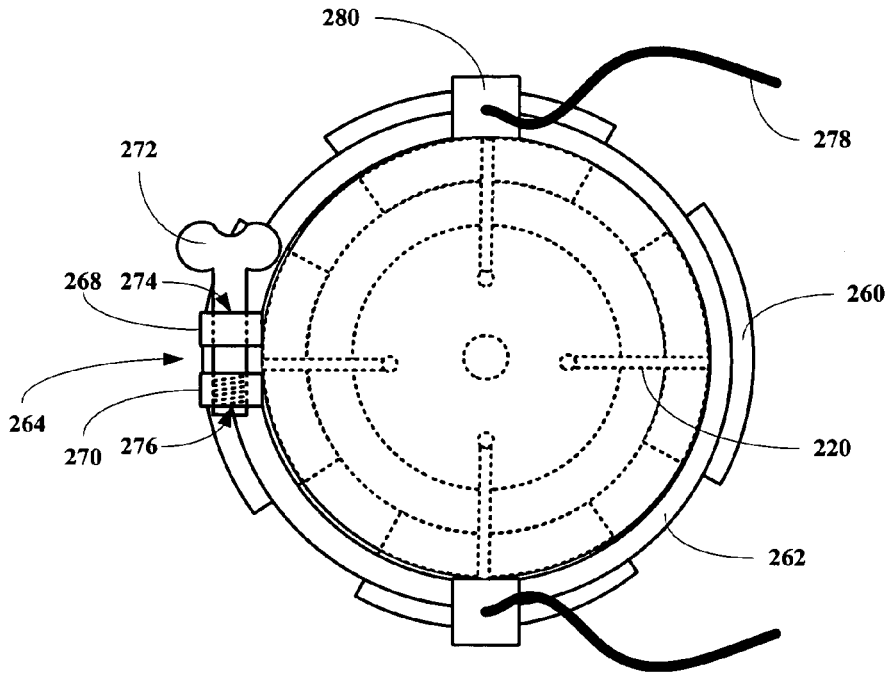

Referring now to FIGS. 2A-C, another embodiment of a paintball gun end cap apparatus, generally 200, is shown to include an internal portion 210 and an external portion 250. The internal portion 210 includes a cylindrical barrel plug insert 212 having a paintball penetrating member 214 comprising an inwardly pointing spike 216 having a pointed tip 218 and a plurality of vents 220. It should be recognized that although a single penetrating member 214 is shown, a plurality of such members could also be used. The penetrating member 214 is designed to rupture any paintball inadvertently fired or discharged from a paint ball gun (not shown) as it travels down a barrel 222 toward the penetrating member 214. The vents 220 are designed to exhaust any gases or fluid generated from an inadvertent firing or discharging of a paintball and rupturing of the paintball as it encounters the penetrating member 214.

The external portion 250 includes cap portion 252 and a slotted cylindrical outer barrel engaging portion 254 including a plurality of slots 256 separating a plurality of barrel engaging members 258 having tightening ring supports 260.

Figure 2D:
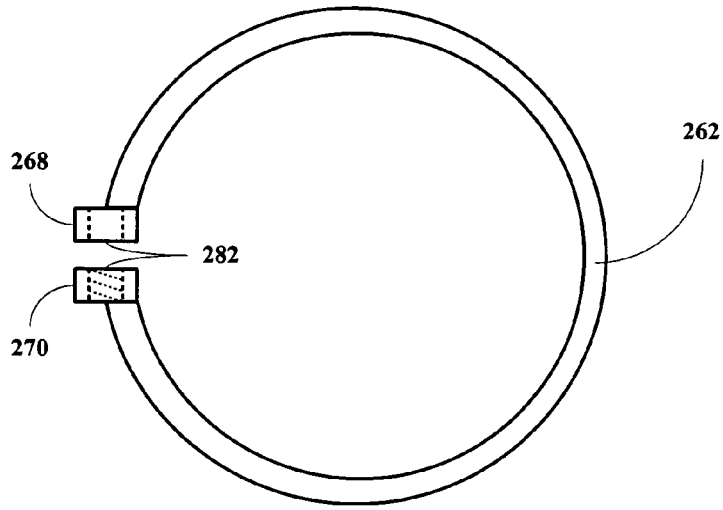

The engaging portion 254 also includes a tightening ring 262 having a tightening assembly 264 associated therewith supported on the ring supports 260. The assembly 264 is designed to tighten the tightening ring 262 generating a sufficient engaging force against a portion 266 of the barrel 222 so that the apparatus cannot be removed without untightening the assembly 264. The tightening assembly 264 includes a guide block 268, a threaded block 270 and a threaded wing nut 272, where the wing nut 272 (or any other threaded bolt that can be tightened using a user's finger) is inserted through an aperture 274 in the guide block 268 and into a threaded aperture 276 in the threaded block 270 so that by screwing the wing nut 272 into the threaded aperture 276, the engaging members 258 are forced towards each other closing the slots 256 generating the engaging force. Additionally, the barrel 222 can include a groove into which a tab on the inside of the outer barrel engaging portion 254 fits to further secure the apparatus 200 to the barrel 222. The apparatus 200 also includes straps 278 and strap blocks 280 affixed to the cap portion 252, where the straps 278 are designed to prevent the end cap apparatus 200 from being lost from the gun when not in use. The straps 278 generally are tied to the gun at their other ends. Looking at FIG. 2D, the tightening ring 262 is shown separated clearly showing that the guide block 268 and the threaded block 270 comprise opposing ends 282 of the tightening ring 262.

Figure 3A:
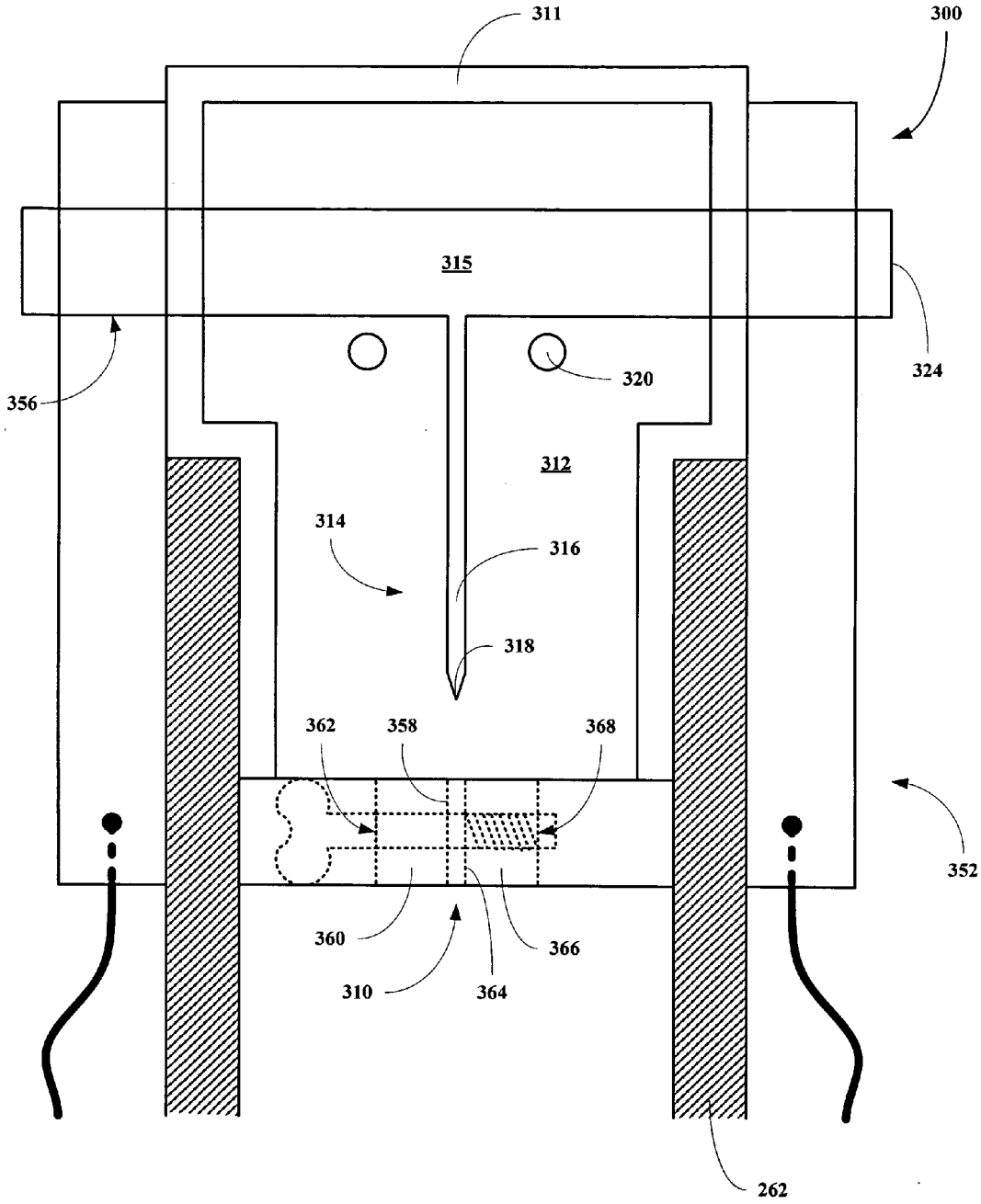
FIGS. 3A-C depict another embodiment of a locking barrel end cap for a paintball gun in a cross-sectional, side and perspective views.
Figure 3B:
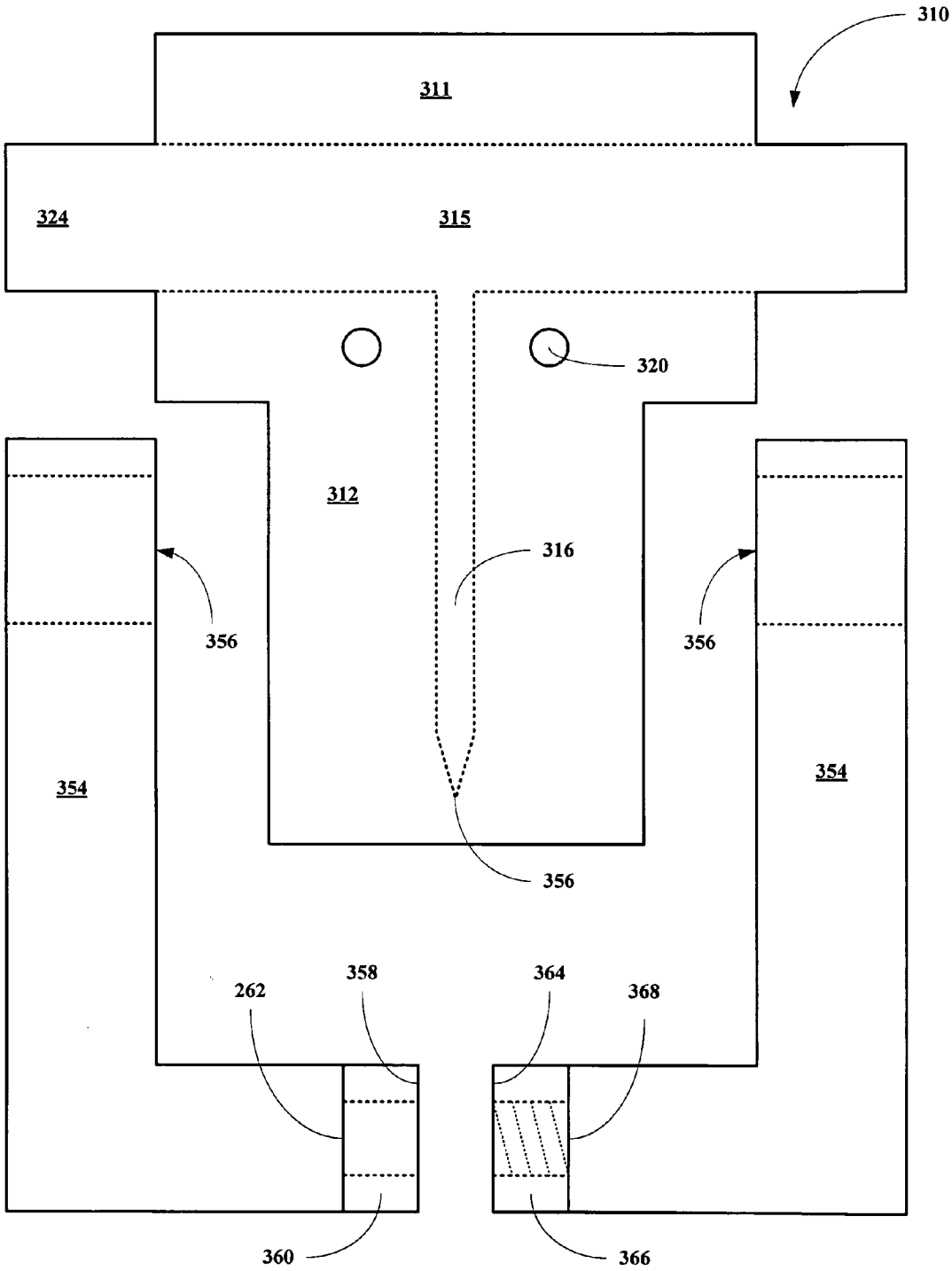
Figure 3C:
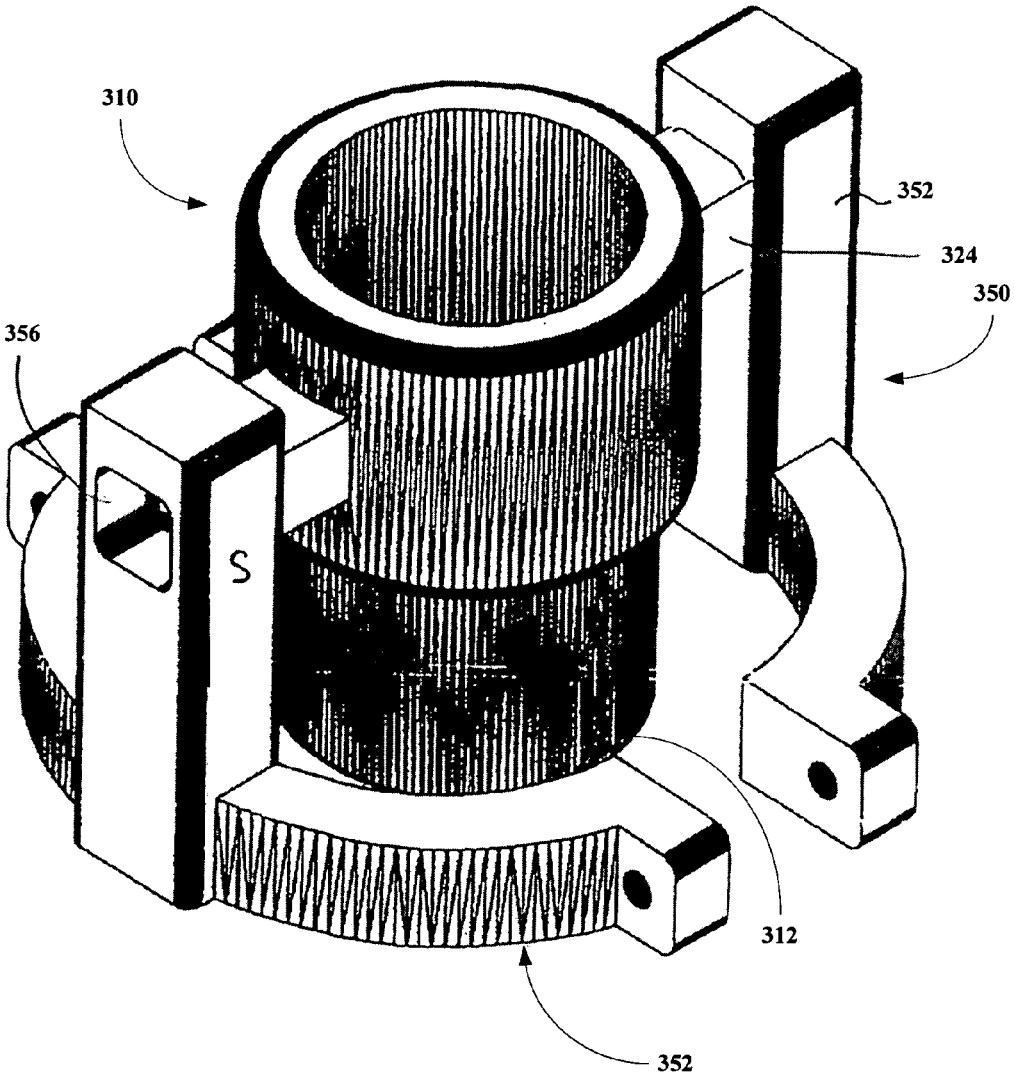

Referring now to FIGS. 3A-C, another embodiment of a paintball gun end cap apparatus, generally 300, is shown to is shown to include an internal portion 310 and an external portion 350. The internal portion 310 includes a larger cylindrical cap portion 311 and a smaller cylindrical barrel insert 312 and a paintball penetrating member 314 comprising an inwardly pointing spike 316 having a pointed tip 318 and a plurality of vents 320. The penetrating member 314 extends inward from a cross-beam 315. It should be recognized that although a single penetrating member 314 is shown, a plurality of such members could also be used. The penetrating member 314 is designed to rupture any paintball inadvertently fired or discharged from a paint ball gun (not shown) as it travels down a barrel 322 toward the penetrating member 314. The vents 320 are designed to exhaust any gases or fluid generated from an inadvertent firing or discharging of a paintball and rupturing of the paintball as it encounters the penetrating member 314. The cap portion 311 includes two protrusions 324 designed to engage apertures on the external portion 350.

The external portion 350 includes two C-shaped barrel engaging members 352, each member 352 including a vertical post 354 having an aperture 356 designed to engage the protrusions 324 so that the members 352 hang from the protrusions 324. Each C-shaped barrel engaging member 352 includes a first end 358 having a guide block 360 including a guide aperture 362 therethrough extending outwardly therefrom. Each C-shaped barrel engaging member 352 also includes a second end 364 having a threaded block 366 including a threaded aperture 368 therethrough extending outwardly therefrom, where the threaded aperture 368 is designed to engage a wing nut (not shown) or other hand tightenable threaded member.

Figure 4:
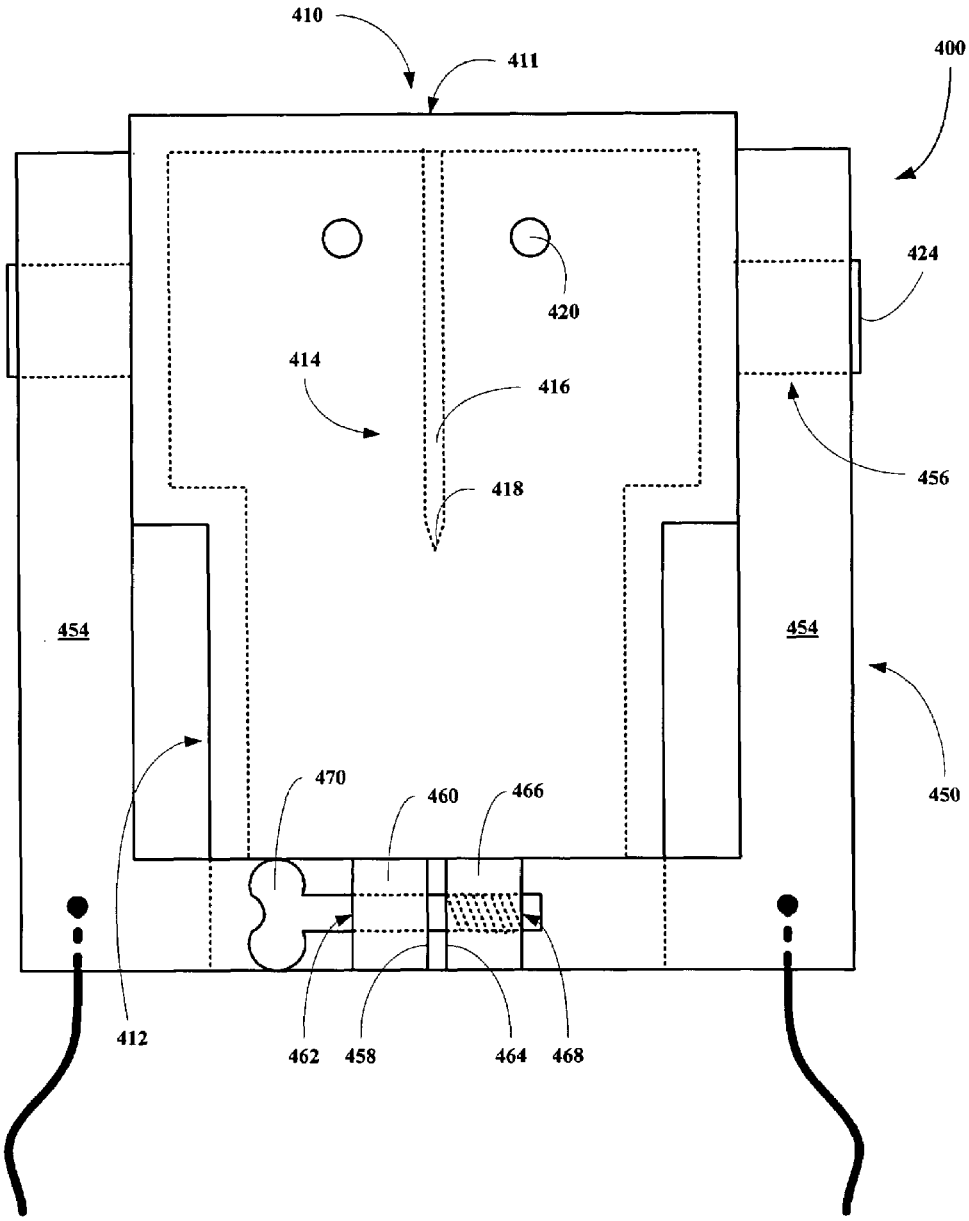
FIG. 4 depicts a side view of another embodiment of a locking barrel end cap for a paintball gun.

Referring now to FIG. 4, another embodiment of a paintball gun end cap apparatus, generally 400, is shown to include an internal portion 410 and an external portion 450. The internal portion 410 includes a larger cylindrical cap portion 411 and a smaller cylindrical barrel insert 412 and a paintball penetrating member 414 comprising an inwardly pointing spike 416 having a pointed tip 418 and further comprising a plurality of vents 420. The penetrating member 414 extends inward from a top 413 of the larger cylindrical cap portion 411. It should be recognized that although a single penetrating member 414 is shown, a plurality of such members could also be used. The penetrating member 414 is designed to rupture any paintball inadvertently fired or discharged from a paint ball gun (not shown) as it travels down a barrel (not shown) toward the penetrating member 414. The vents 420 are designed to exhaust any gases or fluid generated from an inadvertent firing or discharging of a paintball and rupturing of the paintball as it encounters the penetrating member 414. The cap portion 411 includes two protrusions 424 designed to engage apertures on the external portion 450.

The external portion 450 includes two C-shaped barrel engaging members 452, each member 452 including a vertical post 454 having an aperture 456 designed to engage the protrusions 424 so that the members 452 hang from the protrusions 424. Each C-shaped barrel engaging member 452 includes a first end 458 having a guide block 460 including a guide aperture 462 therethrough extending outwardly therefrom. Each C-shaped barrel engaging member 452 also includes a second end 464 having a threaded block 466 including a threaded aperture 468 therethrough extending outwardly therefrom, where the threaded aperture 468 is designed to engage a wing nut 470 or other hand tightenable threaded member.

Although several locking assemblies have been shown for securing the end cap apparatuses of this invention to an end of a paintball barrel, other locking assemblies can also be used and are considered equivalents of the threaded connectors shown above. For example, the locking assembly could comprise a clamping device with a release such as a vice-grip, the C-shaped members could have clips or pins, or the ring could be a slotted band with a tightening screw. These and other tightening assemblies can be used equivalently in the barrel end caps of this invention.

Referring now to FIGS. 5A-C, an embodiment of a closed ended tubular barrel engaging and locking assembly of this invention, generally 500, is shown to include a tube 502 having an opened end 504 and a closed end 506. The assembly 500 also includes a sleeve type tightener 508 having a top 510, a bottom 512 and a inner threaded region 514. The tube or tubular member 502 also includes a plurality of vents 516 disposed at or near the closed end 506, where near means within about 0.75" of the closed end 506 and preferably as close to the closed end 506 as practicable. The tube 502 also includes a plurality of barrel engaging members 518 pivotally mounted within a equal plurality of apertures 520 disposed near the opened end 504 of the tube 502. The tube 502 also includes an outer threaded region 522. The threaded region 514 is designed to engage the threaded region 522, when the tightener 508 is turned the tightener 508 either to tighten or loosen the tightener 508.

Looking at FIGS. 5C&D, the engaging members 518 are in the shape of a triangular solid and include rubber pads 524 disposed on their inner surfaces 526 for frictionally engaging a barrel 528 of a paintball gun (not shown) as shown in FIG. 5B. Each member 518 includes a groove 530 and two raised trapezoid shaped portion 532 disposed one each side 534 of the member 518. Each aperture 520 includes a tongue 536 adapted to engage the groove 530 so that the member 518 can pivot on the tongue 536. Each aperture 520 also includes a trapezoid shaped groove 538 adapted to engage the portion 532 so that the member 518 can pivot in a guided manner relative to the tongue 536.

The tube 502 also includes a paintball penetrator 540 having a tip 542, where the penetrator 540 is disposed on an inner surface 544 of the closed end 506 and is designed to rupture any paintball impinging on the tip 542. The tube 502 can also include penetrator reinforcing members 546. The tube 502 can also include a penetrator protector 548 disposed on the penetrator 532 near its tip 542. The tube 502 can also includes a plurality of radially disposed grooves 550. The sleeve tighter 508 can also included a longitudinally extending ribbed pattern 552 for easy of turning.

Looking at FIGS. 5E&F, the assembly 500 is shown to also includes a penetrator protector 554 including a raised top portion 556 and an aperture therethrough 558 adapted to mount the protector 554 on the pentrator 540. The protector 554 is shown here to be in the shape of a twelve sided polygon having convex surfaces 560 and concave surfaces 562 and is preferably made out of metal such as aluminum and is designed to take a majority of force of a paintball impinging on the penetrator. Looking at FIGS. 5E&F, the assembly 500 is shown to also includes a penetrator protector 564. The protector 564 is also shown here to be in the shape of a twelve sided polygon with convex surfaces 566 and concave surfaces 568 and is preferably made out rubber. Although the protectors 554 and 564 are shown to be twelve sided polygons having convex and concave surfaces, the protectors can be of any shape such as circular, oval, triangular, rectangular, pentagon, hexagonal, etc. and can include convex and/or concave surfaces.

Detailed Description of New Figures

Figure 6B:
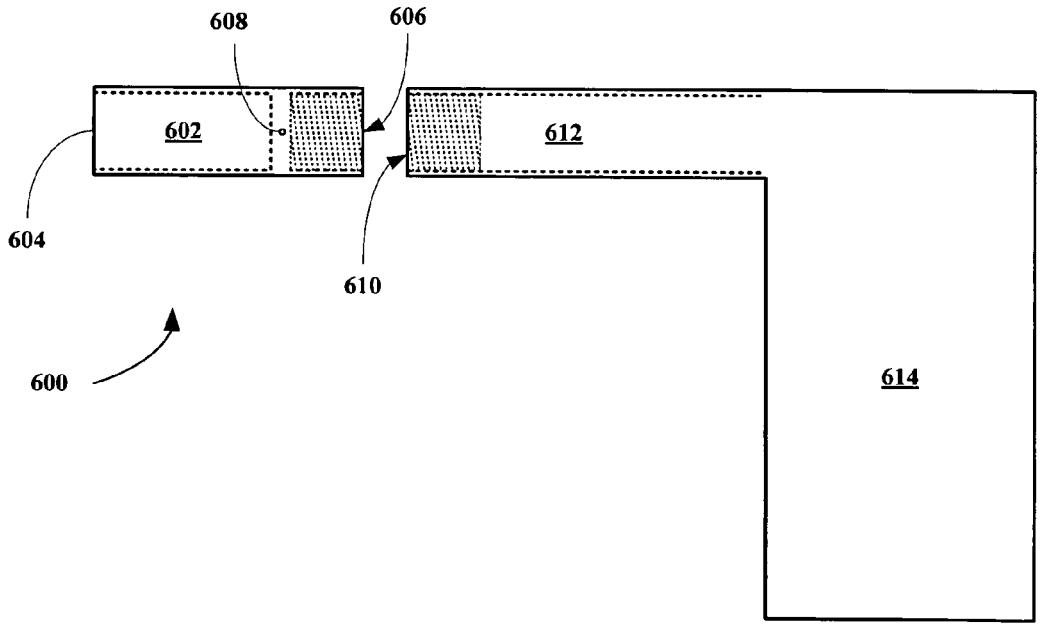

Referring now to FIG. 6A, an embodiment of a screw-on, hollow, end barrel locking assembly of this invention, generally 600, is shown to include a hollow tube 602 having an open, threaded end 604 and a closed end 606 optionally including one or a plurality of vents 608. The assembly 600 is designed to be screwed into a threaded end 610 of a barrel 612 of a non-lethal propellant drive guns 614. Referring now to FIG. 6B, another embodiment of a screw-on end barrel locking assembly of this invention, generally 600, is shown to include a tube 602 having an end 604 and a threaded closed end 606 optionally including one or a plurality of vents 608. The assembly 600 is designed to be screwed into a threaded end 610 of a barrel 612 of a non-lethal propellant drive guns 614.

Figure 7B:
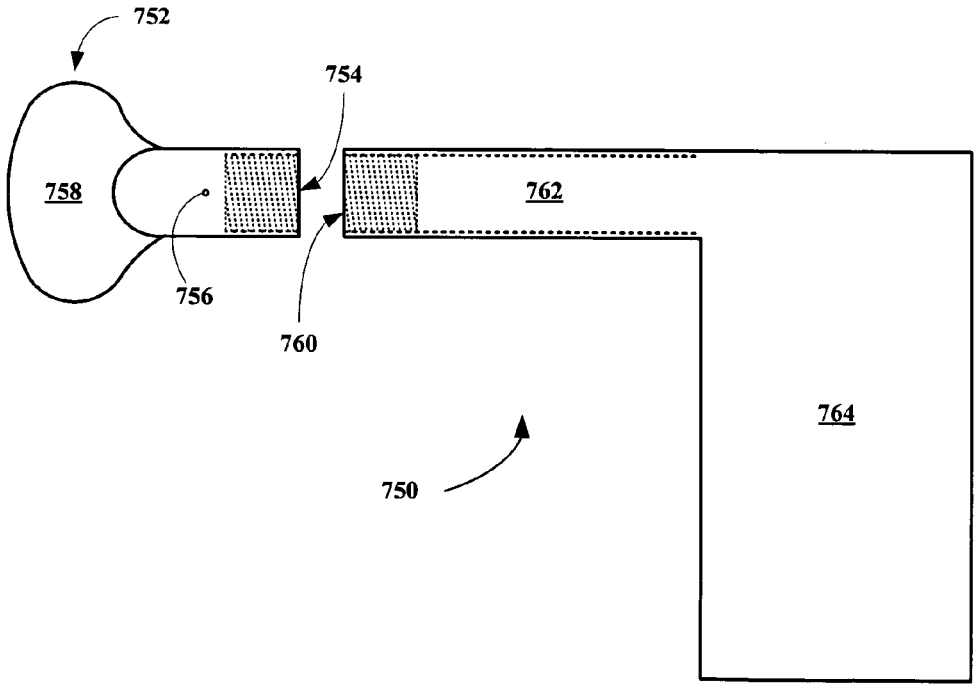

Referring now to FIG. 7A, an embodiment of a screw-on barrel end cap of this invention, generally 700, is shown to include a cap 702 having a threaded end 704, a vent 706 and a grip 708 for allowing a user to tight and un-tighten the cap 700. Referring now to FIG. 7B, another preferred embodiment of a screw-on barrel end cap of this invention, generally 750, is shown to include a cap 752 having a threaded end 754, a vent 756 and a tapered wing-type grip 758 for allowing a user to tight and un-tighten the cap 700.

Referring now to FIG. 8, an embodiment of a pin-type barrel locking assembly of this invention, generally 800, is shown to include a barrel pin 802 having a head 804, a body 806 and a distal end 808 having a barrel pin aperture 810 therethrough and a retaining pin 812 designed to be inserted into the locking pin aperture 810. The assembly 800 also includes a locking pin line 814 attached at one end 816 to the pin head 804 and at its other end 818 to a first line attachment block 820 affixed to a barrel 822. The assembly 800 also includes a retaining pin line 824 attached at one end 826 to the retaining pin 810 and at its other end 828 to a second line attachment block 830 also affixed to the barrel 824. The barrel 824 includes a barrel aperture 832 therethrough to receive the barrel locking pin 802.

Referring now to FIGS. 9A&B, another embodiment of a pin-type barrel locking assembly of this invention, generally 900, is shown to include a barrel pin 902 having a head 904, a body 906, a distal end 908, a head end o-ring 910 and a distal end o-ring 912. The assembly 900 also includes a barrel pin line 914 attached at one end 916 to the pin head 904 and at its other end 918 to a first line attachment block 920 affixed to a barrel 922. The assembly 900 also includes a locking pin holder 924 affixed to the barrel 922. The barrel 922 includes a barrel aperture 926 therethrough to receive the barrel locking pin 902 so that the o-rings 910 and 912 seal the barrel aperture 926.

Figure 10B:
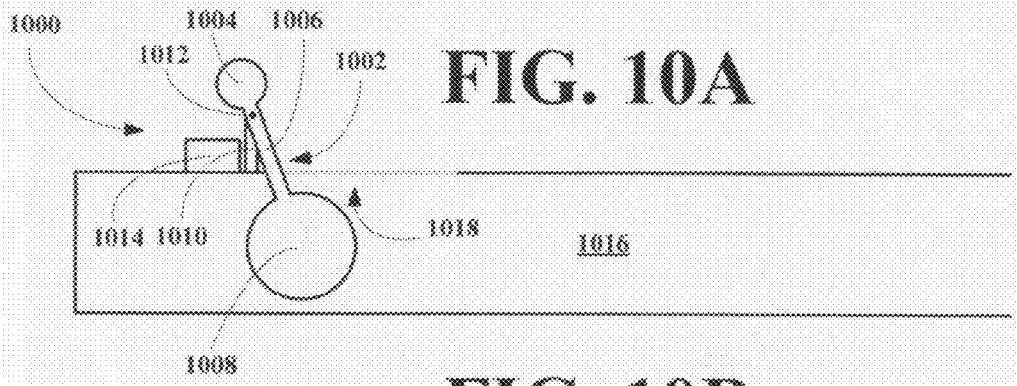

Referring now to FIGS. 10A-B, an embodiment of a lever-type barrel locking assembly of this invention, generally 1000, is shown to include a lever 1002 having a first end 1004, a body 1006 and a second end 1008. The lever 1002 is mounted on a lever mount 1010 via a pin 1012, which allows the lever 1002 to pivot relative to the mount 1010 and block the barrel 1016 when the lever 1002 is in its deployed state. The assembly 1000 also includes a lever retaining block 1014 affixed to the barrel 1016, which includes a slot 1018 through which the second end 1008 of the lever 1002 travel when in its deployed state to block the barrel 1016 as shown in FIG. 10B.

Figure 11B:
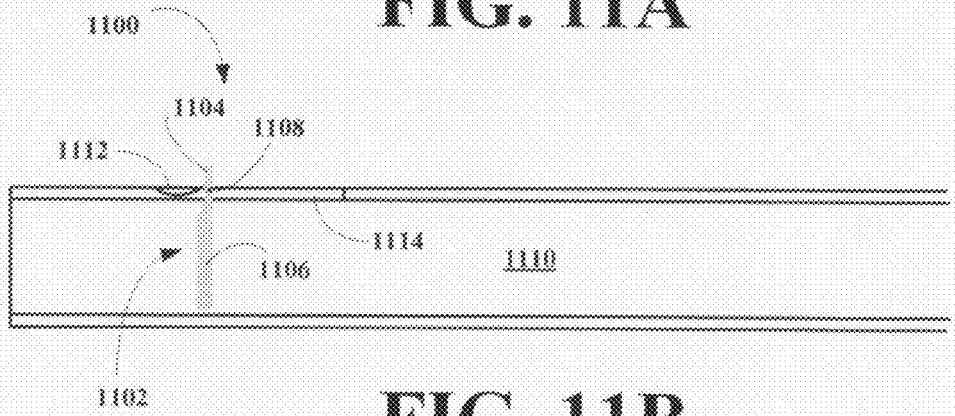

Referring now to FIGS. 11A-B, an embodiment of a lever-type barrel locking assembly of this invention, generally 1100, is shown to include a lever 1102 having a first end 1104, and a second end 1106. The lever 1002 is mounted on a pin 1108, which allows the lever 1002 to pivot relative to the pin 1108. The lever 1102 is designed to pivot on the pin 1108 to extend into a barrel 1110 blocking it in its deployed state. The barrel 1110 includes a recess 1112 for allowing the first end 1104 of the lever 1102 to be flush with a surface 1114 of the barrel 1110 when in its non-deployed state and to be lifted to block the barrel 1110. The barrel 1110 also includes a slot 1116 through which the second end 1106 of the lever 1102 to block the barrel 1110 as shown in FIG. 1B.

New Embodiments

Referring now to FIGS. 12A-C, another embodiment of a threaded-type barrel locking assembly of this invention, generally 1200, is shown to include a barrel 1202 having an external thread section 1204 near its distal end 1206. The barrel 1202 can also include a threaded section 1208 at its proximal end 1210, where it would screw into an handle section of a paintball gun (not shown) or the paintball gun can just come equip with an external threaded section near its distal end.

The assembly 1200 also includes a barrel blocking apparatus 1220. The barrel blocking apparatus 1220 includes a closed end 1222, a spike 1224 and a plurality of vents 1226, where the spike 1224 is adapted to rupture an inadvertently fired paintball and the vents 1226 is designed to vent any pressure build up and allow the paint in any ruptured paintball to flow out of the apparatus 1220. The barrel blocking apparatus 1220 also includes an open end 1228 and an internal threaded section 1230, where the internal threaded section 1230 of the apparatus 1220 and the external threaded section 1206 are adapted to form a threaded connection 1232, when the apparatus 1220 is threaded onto the distal end 1206 of the barrel 1202. The barrel blocking apparatus 1220 also includes a band 1234 having a plurality of lights 1236. The lights 1236 are powered by a battery 1238 wired to the lights 1236 by wires 1240.

The present invention also relates to a barrel for a paintball gun including an external threaded section near its distal end. If the barrel is designed to be removed from the paintball gun, then the barrel also included a proximal threaded section so that the barrel can be screwed into the gun.

Referring now to FIGS. 13A-C, an embodiment of a quick connection-type barrel locking assembly of this invention, generally 1300, is shown to include a barrel 1302 having an enlarged section 1304 near its distal end 1306. The enlarged barrel section 1304 includes two rows 1308*a*&*b* of indentations 1310*a*&*b*. The barrel 1302 can also includes a threaded section at its proximal end (not shown), where it would screw into an handle section of a paintball gun (not shown) or the paintball gun can just come equip with a barrel having an enlarged section near its distal end.

The assembly 1300 also includes a barrel blocking apparatus 1320. The barrel blocking apparatus 1320 includes a closed end 1322, a spike 1324 and a plurality of vents 1326, where the spike 1324 is adapted to rupture an inadvertently fired paintball and the vents 1326 is designed to vent any pressure build up and allow the paint in any ruptured paintball to flow out of the apparatus 1320. The barrel blocking apparatus 1320 also includes an open end 1328 and an engaging section 1330 having a plurality of spring loaded engaging members 1332. The spring loaded engaging members 1332 are designed to engage the indentations 1310*a* or 1320*b* of the first row 1308*a* or second row 1308*b* of the barrel 1302. The barrel blocking apparatus 1320 also includes a band 1334 having a plurality of lights 1336 as shown in FIGS. 13A-C. The lights 1336 are powered by a battery 1338 wired to the lights 1336 by wires 1340. Although the lights 1334 are shown disposed in a band region 1336 of the apparatus 1320, the lights can also be arranged in a pattern or randomly distributed on the apparatus 1320.

The present invention also relates to a barrel for a paintball gun including an external threaded section near its distal end. If the barrel is designed to be removed from the paintball gun, then the barrel also included a proximal threaded section so that the barrel can be screwed into the gun.

Figure 14E:
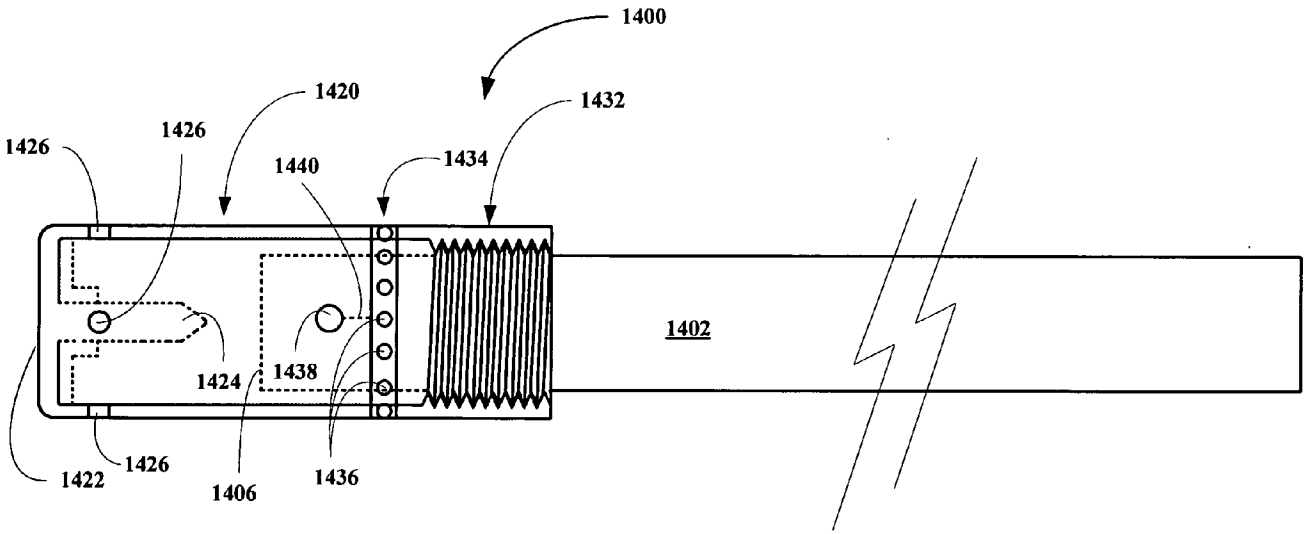

Referring now to FIGS. 14A-E, an embodiment of a thread-type barrel locking assembly of this invention, generally 1400, is shown to include a barrel 1402. The assembly 1400 also includes a thread ring-type section 1404 (FIG. 14B) that is designed to be pushed onto the barrel 1402 at its distal end 1406 (FIG. 14C). The thread section 1404 is then either glued in place or is set in place by one or a plurality of Allen-type set screw (not shown). The threaded section 1404 is then designed to provide the barrel 1402 with a male threaded connector to engage a female connector associated with a barrel blocking apparatus as described below.

The assembly 1400 also includes a barrel blocking apparatus 1420. The barrel blocking apparatus 1420 includes a closed end 1422, a spike 1424 and a plurality of vents 1426, where the spike 1424 is adapted to rupture an inadvertently fired paintball and the vents 1426 is designed to vent any pressure build up and allow the paint in any ruptured paintball to flow out of the apparatus 1420. The barrel blocking apparatus 1420 also includes an open end 1428 and an internal threaded section 1430, where the internal threaded section 1430 of the apparatus 1420 and the external threaded section 1406 are adapted to form a threaded connection 1432, when the apparatus 1420 is threaded onto the distal end 1406 of the barrel 1402. The barrel blocking apparatus 1420 also includes a band 1434 having a plurality of lights 1436. The lights 1436 are powered by a battery 1438 wired to the lights 1436 by wires 1440.

Referring now to FIGS. 15A-D, an embodiment of a quick connect-type barrel locking assembly of this invention, generally 1500, is shown to include a barrel 1502 having a flared section 1504 near its distal end 1506. The flared section 1504 includes ring indentation or groove 1508 disposed on an inner surface 1510 of the barrel 1502. The barrel 1502 can also includes a threaded section at its proximal end (not shown), where it would screw into an handle section of a paintball gun (not shown) or the paintball gun can just come equip with a barrel having an enlarged section near its distal end.

Figures 15A, 15B, 15C, 15D:
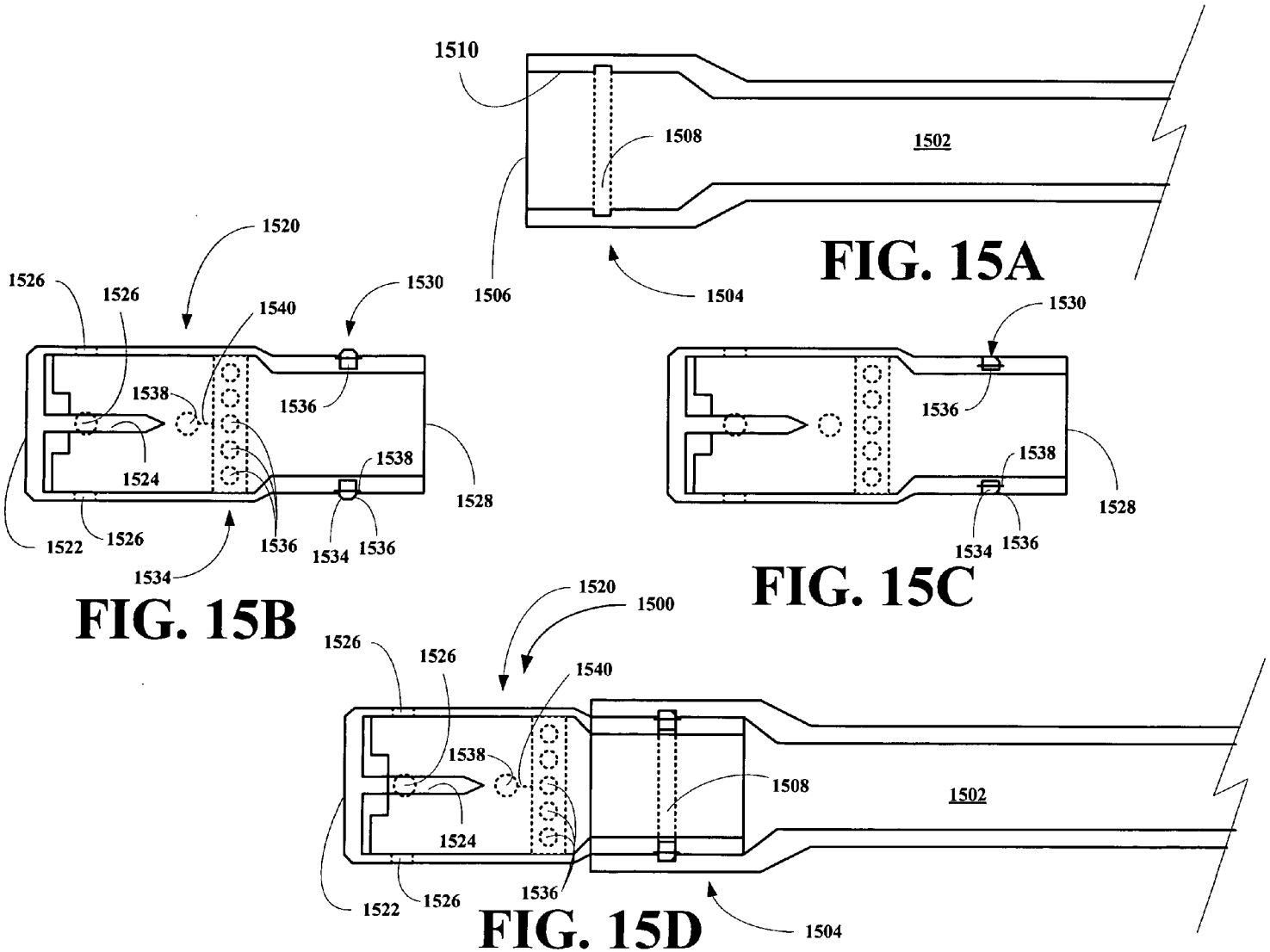

The assembly 1500 also includes a barrel blocking apparatus 1520. The barrel blocking apparatus 1520 includes a closed end 1522, a spike 1524 and a plurality of vents 1526, where the spike 1524 is adapted to rupture an inadvertently fired paintball and the vents 1526 is designed to vent any pressure build up and allow the paint in any ruptured paintball to flow out of the apparatus 1520. The barrel blocking apparatus 1520 also includes an open end 1528 and a plurality of protruding assemblies 1530. The protruding assemblies 1530 include a bias means 1532 and a protrusion 1534 having beveled edges 1536 and a stop 1538. Looking a FIG. 15B, the protruding assemblies 1530 are shown extended, while looking at FIG. 15C, the protruding assemblies 1530 are shown compressed. The apparatus 1520 is then designed to be inserted into the distal end 1506 until the protrusions 1534 spring into the groove 1508 as shown in FIG. 15D. The barrel blocking apparatus 1520 also includes a band 1540 having a plurality of lights 1542. The lights 1542 are powered by a battery 1544 wired to the lights 1542 by wires 1546.

The present invention also relates to a barrel for a paintball gun including a flared section near its distal end having a ring indentation or groove. If the barrel is designed to be removed from the paintball gun, then the barrel also included a proximal threaded section so that the barrel can be screwed into the gun.

Referring now to FIGS. 16A-C, an embodiment of a threaded barrel locking assembly of this invention, generally 1600, is shown to include a barrel 1602 having a flared section 1604 near its distal end 1606. The flared section 1604 includes a threaded section 1608 disposed on an inner surface 1610 of the barrel 1602. The barrel 1602 can also includes a threaded section at its proximal end (not shown), where it would screw into an handle section of a paintball gun (not shown) or the paintball gun can just come equip with a barrel having an enlarged section near its distal end.

Looking at FIG. 16B, The assembly 1600 also includes a barrel blocking apparatus 1620. The barrel blocking apparatus 1620 includes a closed end 1622, a spike 1624 and a plurality of vents 1626, where the spike 1624 is adapted to rupture an inadvertently fired paintball and the vents 1626 is designed to vent any pressure build up and allow the paint in any ruptured paintball to flow out of the apparatus 1620. The barrel blocking apparatus 1620 also includes an open end 1628 and an externally threaded section 1630. The apparatus 1620 is then designed to be inserted into the distal end 1606 and screwed into place to form a threaded connection 1632 as shown in FIG. 16C. The barrel blocking apparatus 1620 also includes a band 1634 having a plurality of lights 1636. The lights 1636 are powered by a battery 1638 wired to the lights 1636 by wires 1640.

The present invention also relates to a barrel for a paintball gun including a flared section near its distal end having a internally threaded section. If the barrel is designed to be removed from the paintball gun, then the barrel also included a proximal threaded section so that the barrel can be screwed into the gun.

Referring now to FIGS. 17A-D, an embodiment of a multipurpose barrel blocking and mounting assembly of this invention, generally 1700, is shown to include a barrel 1702 having an external thread section 1704 near its distal end 1706. The barrel 1702 can also include a threaded section at its proximal end, where it would screw into an handle section of a paintball gun (not shown) or the paintball gun can just come equip with an external threaded section near its distal end.

Looking at FIG. 17B, the assembly 1700 also includes a multi-purpose barrel apparatus 1720. The multi-purpose apparatus 1720 includes a barrel blocking apparatus 1730 and a barrel magnetic mounting apparatus 1760. The barrel blocking apparatus 1730 includes a closed end 1732, a spike 1734 and a plurality of vents 1736, where the spike 1734 is adapted to rupture an inadvertently fired paintball and the vents 1736 is designed to vent any pressure build up and allow the paint in any ruptured paintball to flow out of the barrel blocking apparatus 1730. The barrel blocking apparatus 1730 also includes an open end 1738 and an internal threaded section 1740. The internal threaded section 1740 of the barrel blocking apparatus 1730 and the external threaded section 1706 are adapted to form a threaded connection 1742, when the barrel blocking apparatus 1730 is threaded onto the distal end 1706 of the barrel 1702. The barrel blocking apparatus 1730 also includes a band 1744 having a plurality of lights 1746. The lights 1746 are powered by a battery 1748 wired to the lights 1746 by wires 1750.

The barrel mounting apparatus 1760 includes a hollow body 1762 having a distal end 1764 and a proximal end 1766. The apparatus 1760 also includes an internally threaded section 1768 located at or near the proximal end 1766 of the mounting apparatus 1760. Like the barrel blocking apparatus 1730, the internal threaded section 1768 of the mounting apparatus 1760 and the external threaded section 1706 are adapted to form a threaded connection 1770, when the barrel blocking apparatus 1730 is threaded onto the distal end 1706 of the barrel 1702. The mounting apparatus 1760 is mounted to the barrel blocking apparatus 1730 at permanent or detachable connector 1772. The mounting apparatus 1760 includes a plurality of magnetic mounts 1774*a-c*, shown here as to row of three magnetic (four shown). Two mounts 1774*a* are position opposite the connector 1772. Two mounts 1774*b* are located on right-side of the body 1762 (looking down the barrel), and two on the right side of the body 1762 (not shown). The magnetic mounts 1774 are designed to permit the mounting of sights, scopes, lights or other types paintball aids.

Looking at FIG. 17C, the assembly 1700 is shown screwed onto the barrel 1702 via the barrel blocking apparatus 1730, while the mounting apparatus 1760 is disposed on a bottom side 1712 of the barrel 1702. Looking at FIG. 17D, the assembly 1700 is shown screwed onto the barrel 1702 via the mounting apparatus 1760, while the barrel blocking apparatus 1730 is disposed on a bottom side 1712 of the barrel 1702. Looking at FIG. 17E, the assembly 1700, with the mounting apparatus 1760 screwed onto the distal end 1706 of the barrel 1702, the assembly 1700 also includes a scope 1776 mounted on the top mounts 1774*a* via magnets 1778 disposed on the underside 1780 of the scope 1776. The assembly 1700 also includes a light 1782 mounted on the left-side mounts 1774*c* via magnets 1784 disposed on the underside 1786 of the light 1782. Although the scope and light are shown attached using magnetics, the mounts 1774 and the magnets 1778 and 1784 can be any type of mounting device including snaps, threaded connections, slide connectors with a tightener or any other type of mounting means to mount the scope or light on the mounting apparatus 1760.

Referring now to FIGS. 18A-D, an embodiment of a multi-purpose barrel blocking and mounting assembly of this invention, generally 1800, is shown to include a barrel 1802 having an external thread section 1804 near its distal end 1806. The barrel 1702 can also include a threaded section at its proximal end, where it would screw into an handle section of a paintball gun (not shown) or the paintball gun can just come equip with an external threaded section near its distal end.

Looking at FIG. 18B, the assembly 1800 also includes a multi-purpose barrel apparatus 1720. The multi-purpose apparatus 1820 includes a barrel blocking apparatus 1830 and a barrel magnetic mounting apparatus 1860. The barrel blocking apparatus 1830 includes a closed end 1832, a spike 1834 and a plurality of vents 1836, where the spike 1834 is adapted to rupture an inadvertently fired paintball and the vents 1836 is designed to vent any pressure build up and allow the paint in any ruptured paintball to flow out of the barrel blocking apparatus 1830. The barrel blocking apparatus 1830 also includes an open end 1838 and an internal threaded section 1840. The internal threaded section 1840 of the barrel blocking apparatus 1830 and the external threaded section 1806 are adapted to form a threaded connection 1842, when the barrel blocking apparatus 1830 is threaded onto the distal end 1806 of the barrel 1802. The barrel blocking apparatus 1830 also includes a band 1844 having a plurality of lights 1846. The lights 1846 are powered by a battery 1848 wired to the lights 1846 by wires 1850.

The barrel magnetic mounting apparatus 1860 includes a hollow body 1862 having a distal end 1864 and a proximal end 1866. The apparatus 1860 also includes clamping apparatus 1868 located at or near the proximal end 1866 of the mounting apparatus 1860. The clamping apparatus 1868 includes engaging member 1870. When the barrel blocking apparatus 1830 is inserted onto the distal end 1806 of the barrel 1802, the clamping apparatus 1868 is tightened causing the engaging members 1870 to engage the threaded section 1804 at the distal end 1806 of the barrel 1802 to form a locking connection 1871. The mounting apparatus 1860 is mounted to the barrel blocking apparatus 1830 at permanent or detachable connector 1872. The mounting apparatus 1860 includes a plurality of magnetic mounts 1874*a-c*, shown here as to row of three magnetic (four shown). Two mounts 1874*a* are position opposite the connector 1872. Two mounts 1874*b* are located on right-side of the body 1862 (looking down the barrel), and two on the right side of the body 1862 (not shown). The magnetic mounts 1874 are designed to permit the mounting of sights, scopes, lights or other types paintball aids.

Looking at FIG. 18C, the assembly 1800 is shown screwed onto the barrel 1802 via the barrel blocking apparatus 1830, while the mounting apparatus 1860 is disposed on a bottom side 1812 of the barrel 1802. Looking at FIG. 18D, the assembly 1800 is shown screwed onto the barrel 1802 via the mounting apparatus 1860, while the barrel blocking apparatus 1830 is disposed on a bottom side 1812 of the barrel 1802. Looking at FIG. 18E, the assembly 1800, with the mounting apparatus 1860 screwed onto the distal end 1806 of the barrel 1802, the assembly 1800 also includes a scope 1876 mounted on the top mounts 1874*a* via magnets 1878 disposed on the underside 1880 of the scope 1876. The assembly 1800 also includes a light 1882 mounted on the left-side mounts 1874*c* via magnets 1884 disposed on the underside 1886 of the light 1882.

Although the barrel blocking apparatuses and the multi-purpose apparatuses of this invention have been shown with a number of different type of detachable locking connections to appropriately designed barrels, any other connecting design can be used to lockingly mount a barrel blocking apparatus to the end of a specifically designed barrel so that the blocking devices can withstand multiple inadvertent paintball firings without endangering innocent bystanders, referees, or other payer before or after a game or training episode. We have shown threaded connections and some quick connectors, but any other type of quick connection connectors can be used such as those disclosed in U.S. Pat. Nos. 4,660,804, 6,786, 516, 6,733,047, 7,044,505, 7,044,506, incorporated therein by reference.

Referring now to FIGS. 19A-J, several embodiments of mounting assemblies of this invention, generally 1900, are shown. Looking at FIGS. 19A&B, a screw-type mount 1900 is shown to including a single mounting member 1902 and a curved elongate mount 1904 having a thumb screw assembly 1906 for engaging a threaded post 1908 of a scope, light or other paintball accessory 1910 that can be mounted on a barrel mount assembly of this invention. The thumb screw assembly 1906 including a housing 1912 including a nut 1914 having a threaded aperture 1916 therethrough and an aperture 1918 in the mount 1904 leading from the nut 1914 to an inner surface 1920 of the mount 1904 adapted to receive the threaded post 1908.

Figure 19B:
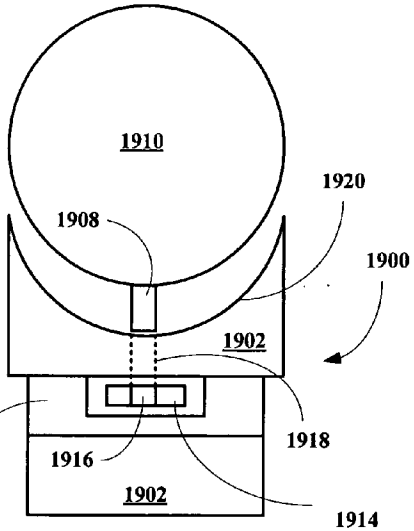
Figure 19A:
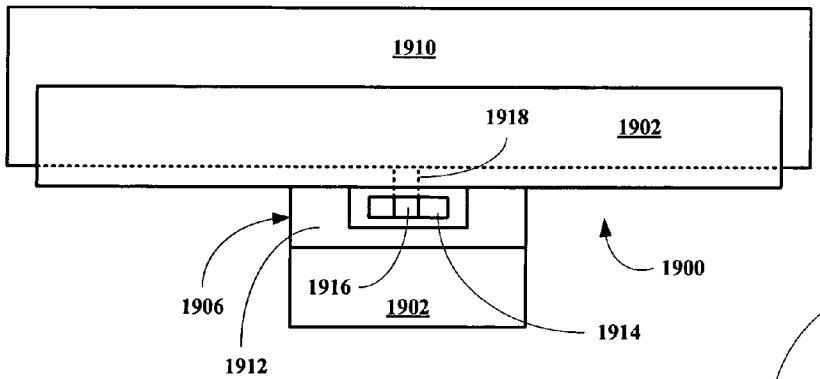
Figure 19D:
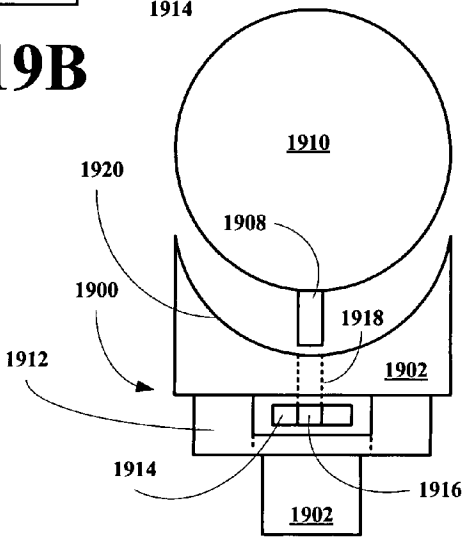
Figure 19C:
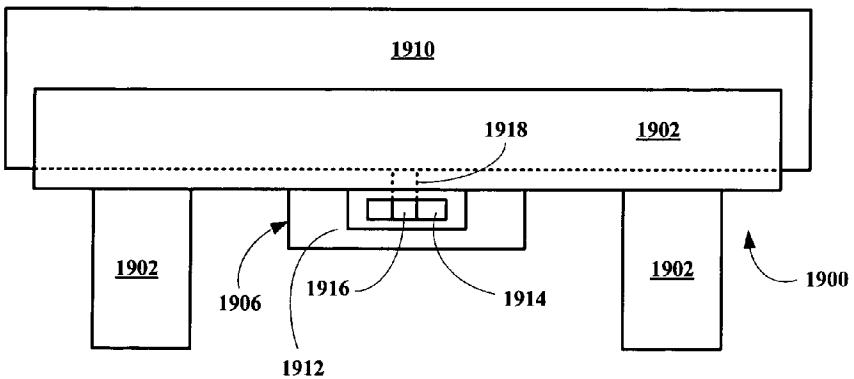
Figure 19F:
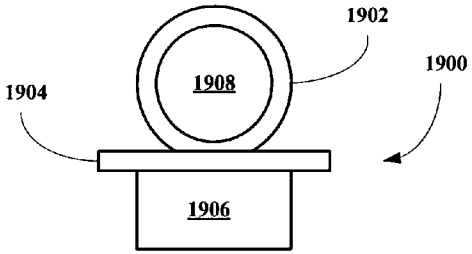
Figure 19H:
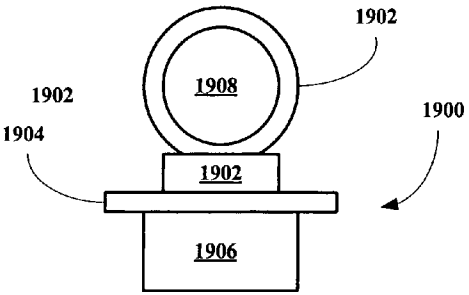
Figure 19J:
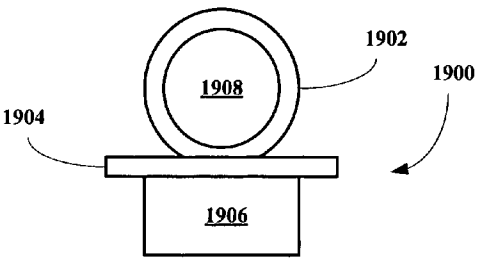

Looking at FIGS. 19C&D, a screw-type mount 1900 is shown to including two mounting members 1902 and a curved elongate mount 1904 having a thumb screw assembly 1906 for engaging a threaded post 1908 of a scope, light or other paintball accessory 1910 that can be mounted on a barrel mount assembly of this invention. The thumb screw assembly 1906 including a housing 1912 including a nut 1914 having a threaded aperture 1916 therethrough and an aperture 1918 in the mount 1904 leading from the nut 1914 to an inner surface 1920 of the mount 1904 adapted to receive the threaded post 1908.

Figure 19E:
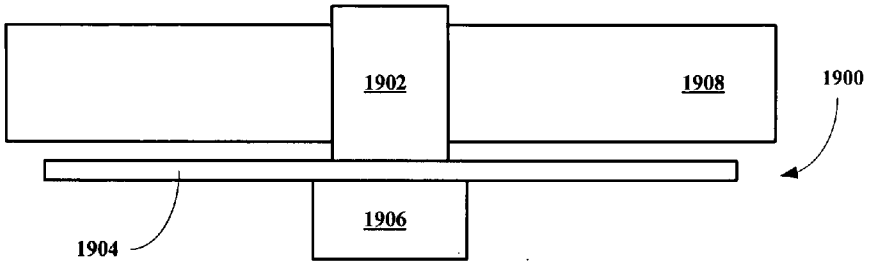

Looking at FIGS. 19E&F, a tube-type mount 1900 is shown to including a tubular member 1902 affixed to a table 1904 which is affixed to a mount 1906. The tubular member 1902 is designed to receive a scope or other tubular paintball accessory 1908.

Figure 19G:
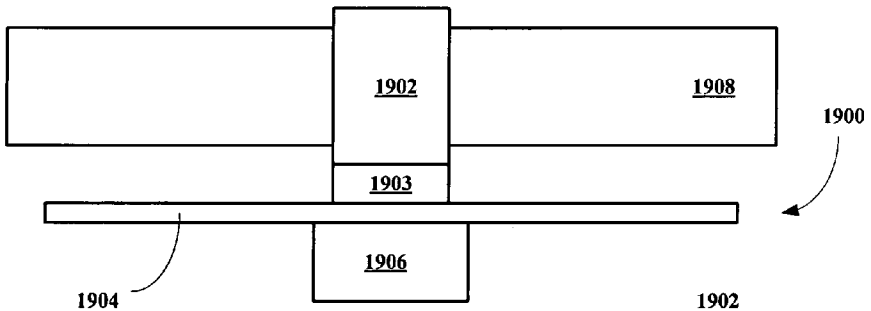

Looking at FIGS. 19G&H, a tube-type mount 1900 is shown to including a tubular member 1902 affixed to a rotatable member 1903 mounted on a table 1904 which is affixed to a mount 1906. The tubular member 1902 is designed to receive a scope or other tubular paintball accessory 1908.

Figure 19I:
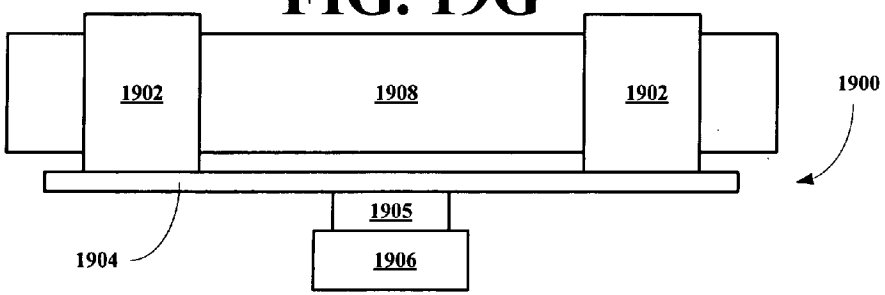

Looking at FIGS. 19I&J, a tube-type mount 1900 is shown to including two tubular members 1902 affixed to a table 1904 which is mounted on a rotatable member 1905 affixed to a mount 1906. The tubular member 1902 is designed to receive a scope or other tubular paintball accessory 1908.

New Embodiments

Referring now to FIG. 20A, another embodiment of barrel blocking apparatus of this invention, generally 2000, is shown to include a barrel engaging member 2002 adapted to engage a distal end 2004 of a barrel 2006 of a non-lethal gun (remainder of the gun is not shown) such as a paintball gun or a foam ball gun. The engaging member 2002 includes engaging connector 2008 having a threaded outer sleeve 2010 adapted to force for engaging pads 2012 disposed at or near a distal end 2013. Each pad 2012 includes a trapezoidal sleeve engaging portion 2014 and a barrel engaging portion 2016. The barrel engaging member 2002 also includes a threaded male connector 2018 disposed at or near a distal end 2020 of the engaging member 2002. The apparatus 2000 also includes a blocking member 2022 including closed end 2024 and an open end 2026. The open end 2026 includes a female threaded connector 2028 adapted to engage the male threaded connector 2018 of the engaging member 2002. Disposed on an inner surface 2030 of the closed end 2024 of the blocking member 2022 is an insert 2032 surrounding a penetrator 2034. The blocking member 2022 also includes a plurality of vents 2036 and optionally a light 2038 adapted to evidence that the barrel blocking member 2022 is attached to the barrel 2006. Looking at FIG. 20B, a view from along the section lines A is shown illustrating now the pads 2012 engage the barrel 2006 once the sleeve 2010 has been tightened along a threaded distal end 2013 of the engaging member 2002.

Referring now to FIG. 21A, another embodiment of barrel blocking apparatus of this invention, generally 2100, is shown to include a barrel engaging member 2102 adapted to engage a distal end 2104 of a barrel 2106 of a non-lethal gun (remainder of the gun is not shown) such as a paintball gun or a foam ball gun. The engaging member 2102 includes engaging connector 2108 having a threaded outer sleeve 2110 adapted to force for engaging pads 2112 disposed at or near a distal end 2113. Each pad 2112 includes a trapezoidal sleeve engaging portion 2114 and a barrel engaging portion 2116. The barrel engaging member 2102 also includes a threaded male connector 2118 disposed at or near a distal end 2120 of the engaging member 2102. The apparatus 2100 also includes a blocking member 2122 including closed end 2124 and an open end 2126. The open end 2126 includes a female threaded connector 2128 adapted to engage the male threaded connector 2118 of the engaging member 2102, and the closed end 2124 includes a second female connector 2129. Disposed on an inner surface 2130 of the closed end 2124 of the blocking member 2122 is an insert 2132 surrounding a penetrator 2134. The blocking member 2122 also includes a plurality of vents 2136. The apparatus 2100 also includes an end member 2138 having a male threaded connector 2140 adapted to engage the second female connector 2129 of the blocking member 2122. The end member 2138 can include lighting means 2142 adapted to evidence that the barrel blocking member 2122 is attached to the barrel 2106 so that participants in a game or an exercise will be able to readily identify inactive participants. The end member 2138 can also include other devices such as sound generators, GPS positioning devices or the like. Looking at FIG. 21B, a view from along the section lines A is shown illustrating now the pads 2112 engage the barrel 2106 once the sleeve 2110 has been tightened along a threaded distal end 2113 of the engaging member 2102.

Referring now to FIG. 22A, another embodiment of barrel blocking apparatus of this invention, generally 2200, is shown to include a barrel engaging member 2202 adapted to engage a distal end 2204 of a barrel 2206 of a non-lethal gun (remainder of the gun is not shown) such as a paintball gun or a foam ball gun. The engaging member 2202 includes engaging connector 2208 having a threaded outer sleeve 2210 adapted to force for engaging pads 2212 disposed at or near a distal end 2213. Each pad 2212 includes a trapezoidal sleeve engaging portion 2214 and a barrel engaging portion 2216. The barrel engaging member 2202 also includes a female quick connector 2218 disposed at or near a proximal end 2220 of the engaging member 2202. The apparatus 2200 also includes a blocking member 2222 including closed end 2224 and an open end 2226. The open end 2226 includes a male quick connector 2228 adapted to engage the female quick connector 2218 of the engaging member 2202, and the closed end 2224 includes a second female quick connector 2229. Disposed on an inner surface 2230 of the closed end 2224 of the blocking member 2222 is an insert 2232 surrounding a penetrator 2234. The blocking member 2222 also includes a plurality of vents 2236. The apparatus 2200 also includes an end member 2238 having a male quick connector 2240 adapted to engage the second female connector 2229 of the blocking member 2222. The end member 2238 can include lighting means 2242 adapted to evidence that the barrel blocking member 2222 is attached to the barrel 2206 so that participants in a game or an exercise will be able to readily identify inactive participants. The end member 2238 can also include other devices such as a front light, a sound generator, a GPS positioning device or the like 2244. Looking at FIG. 22B, a view from along the section lines A is shown illustrating now the pads 2212 engage the barrel 2206 once the sleeve 2210 has been tightened along a threaded distal end 2213 of the engaging member 2202. Looking at FIG. 22C, a view from along the section lines B is shown illustrating now the male quick connector 2228 of the blocking member 2222 engages the female quick connector 2218 of the engaging member 2202. The connector 2228 includes four indentations 2246 adapted to fit into four protrusions 2248 in the connector 2228, while four protrusions 2250 of the connector 2228 fit into four indentations 2252 in the connector 2218. The connector 2228 is pushed into the connector 2218 until the protrusions 2250 of the connector 228 are in a circular groove 2254 in the connector 2218, where the protrusions 2250 are below the lower extent of the protrusions 2252. The connection is then made by simply rotating the blocking member 2222 to the right or left so that the protrusions 2250 of the connector 2228 are coincident with but below the protrusions 2252 of the connector 2218. Although one form of a quick connect is shown, the connection can also be any other quick connect such as the quick connects used in water, gas and air lines such as those disclosed in U.S. Pat. Nos. 4,660,804, 6,786,516, 6,733,047, 7,044,505, 7,044,506, incorporated therein by reference.

Referring now to FIG. 23A, another embodiment of barrel blocking apparatus of this invention, generally 2300, is shown to include a barrel blocking engaging member 2302 located near a distal end 2304 of a barrel 2306 of a non-lethal gun (remainder of the gun is not shown) such as a paintball gun or a foam ball gun, where the member 2302 can be affixed to or integral with of the barrel 2306. The barrel engaging member 2302 also includes a female quick connector 2318 disposed at or near a proximal end 2320 of the engaging member 2302. The apparatus 2300 also includes a blocking member 2322 including closed end 2324 and an open end 2326. The open end 2326 includes a male quick connector 2328 adapted to engage the female quick connector 2318 of the engaging member 2302, and the closed end 2324 includes a second female quick connector 2329. Disposed on an inner surface 2330 of the closed end 2324 of the blocking member 2322 is an insert 2332 surrounding a penetrator 2334. The blocking member 2322 also includes a plurality of vents 2336. The apparatus 2300 also includes an end member 2338 having a male quick connector 2340 adapted to engage the second female connector 2329 of the blocking member 2322. The end member 2338 can include lighting means 2342 adapted to evidence that the barrel blocking member 2322 is attached to the barrel 2306 so that participants in a game or an exercise will be able to readily identify inactive participants. The end member 2338 can also include other devices such as a front light, a sound generator, a GPS positioning device or the like 2344. Looking at FIG. 23B, a view from along the section lines B is shown illustrating now the male quick connector 2328 of the blocking member 2322 engages the female quick connector 2318 of the engaging member 2302. The connector 2328 includes four indentations 2346 adapted to fit into four protrusions 2348 in the connector 2328, while four protrusions 2350 of the connector 2328 fit into four indentations 2352 in the connector 2318. The connector 2328 is pushed into the connector 2318 until the protrusions 2350 of the connector 238 are in a circular groove 2354 in the connector 2318, where the protrusions 2350 are below the lower extent of the protrusions 2352. The connection is then made by simply rotating the blocking member 2322 to the right or left so that the protrusions 2350 of the connector 2328 are coincident with but below the protrusions 2352 of the connector 2318. Although one form of a quick connect is shown, the connection can also be any other quick connect such as the quick connects used in water, gas and air lines such as those disclosed in U.S. Pat. Nos. 4,660,804, 6,786,516, 6,733,047, 7,044,505, 7,044,506, incorporated therein by reference.

Referring now to FIGS. 24A-C, another embodiment of barrel blocking apparatus of this invention, generally 2400, is shown to include a barrel 2402 having an enlarged end section 2404. The enlarged end section 2404 include a plurality of opposing apertures 2406 aligned in a row 2408. The aperture 2406 are designed to receive a pin as described below. The apparatus 2400 also includes a barrel plug 2410. The barrel plug 2410 includes a curved end 2412, a cylindrical protrusion 2414 having a vertical aperture 2416 and ending in a penetrator 2418, a fasting protrusion 2420 having a vertical aperture 2422 and a horizontal aperture 2424 and a pin 2426. The horizontal aperture 2424 is adapted to house the pin 2426 when the plug 2410 is not inserted into the barrel 2402. The apertures 2406 in the section 2404 and the two vertical apertures 2416 and 2422 are designed to receive the pin 2426 when the plug 2410 is inserted in to the barrel 2402. The pin 2426 can have include spring loaded stops 2428 that prevent the pin 2426 from falling out once it has been inserted though the apertures 2406 in the section 2404 and the vertical apertures 2416 and 2422.

Detailed Description of Figures for This CIP

Referring now to FIGS. 25A-E, another embodiment of barrel blocking apparatus of this invention, generally 2500, is shown. Looking at FIG. 25A, the apparatus 2500 includes a barrel plug or insertion portion 2502 and an outer portion 2504. The insertion portion 2502 includes a center post 2506 attached to or mounted on a top section 2508 of the outer portion 2504. The outer portion 2504 also includes a surrounding section 2510. The top section 2508 is mounted in a groove 2512 in the surrounding section 2510 of the outer portion 2504, while the central post 2506 extends through an aperture 2514 in the surrounding section 2510.

Figure 25A:
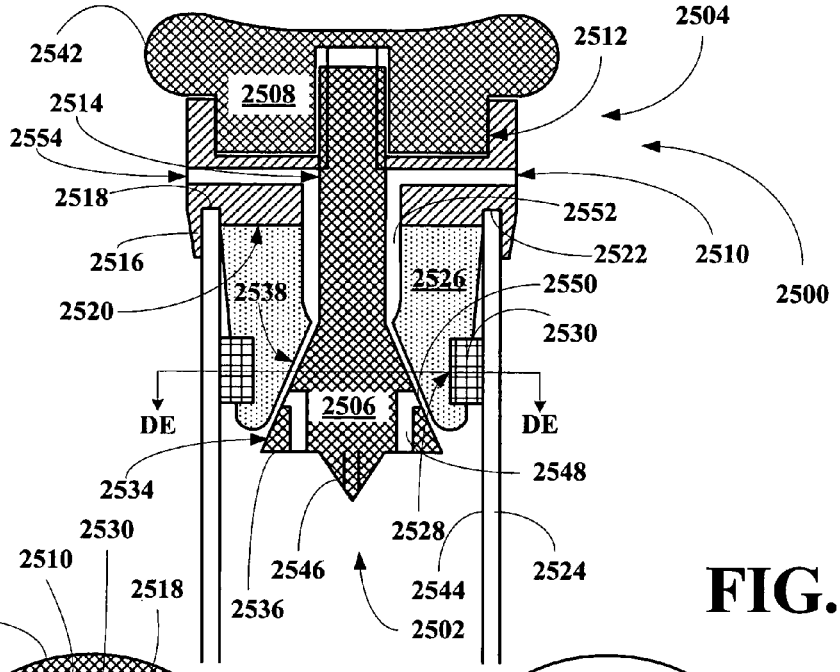
Figure 25B:
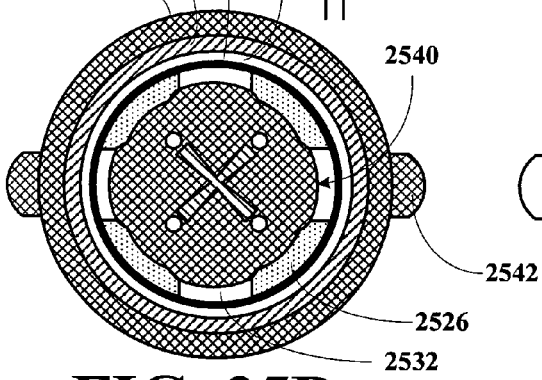
Figure 25C:
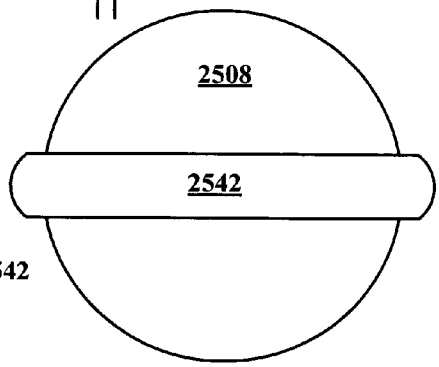
Figure 25D:
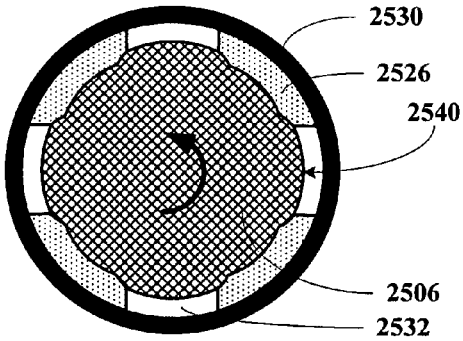
Figure 25E:
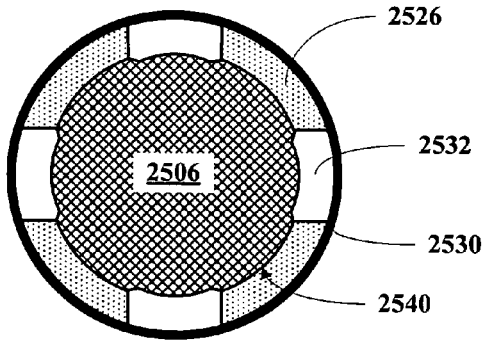

The surrounding section 2510 also includes an outer downwardly extending lip 2516 and a circular groove 2518 disposed on a lower surface 2520 of the surrounding section 2510 adjacent the lip 2516 and adapted to receive the end 2522 of the barrel 2524 of a paintball gun or other non-lethal gun. Extending from the lower surface 2520 of the surrounding section 2510 adjacent the groove 2518 are a plurality (four here) of prongs 2526 that form part of the insertion portion 2502. The prongs 2526 include grooves 2528 adapted to receive a friction ring (O-ring here) 2530. The prongs 2526 are spaced apart to form gaps 2532 therebetween as shown in FIGS. 25B, 25D and 25E.

The central post 2506 includes a flared portion 2534 near its distal end 2536. The prongs 2526 have inner surfaces 2538 conformed to the flared portion 2534 of the post 2506. In the flared portion 2534 of the post 2506 are raised sections 2540 as shown in FIGS. 25B, 25D and 25E, which are designed to be disposed in the gaps 2532 between the prongs 2526 when the apparatus 2500 is its unlocked state. The top section 2508 includes a winged shaped member 2542 adapted to be turned by a user so that the top section 2508 can be rotated relative to the surrounding section 2510. When the top section 2508 is rotated via the member 2542, the post 2506 also rotates. After about a quarter turn, the post 2506 rotates sufficient to engage the conforming surfaces 2538 of the prongs 2526 are pushed outward compressing the fiction ring 2530 forcing it against an inner surface 2544 of the barrel 2524 to frictionally lock the apparatus 2500 in place. This locking process is shown in the transitional FIGS. 25D and 25E (cut along the section line DE), which show the apparatus 2500 its unlocked state and in its locked state, respectively, showing the compression of the friction ring 2530.

The central post 2506 can also include a penetrator 2546 disposed in the distal end 2536 of the post 2506 and adapted to assist in rupturing paintball that are inadvertently fired from the gun. The post 2506 can also include vents 2548 in its distal end 2536 opening at locations 2550 in the flared section 2534 of the post 2506. The vents 2548 are blocked when the apparatus 2500 is in its unlocked state, but open into connecting conduits 2552 that extend up along the post 2506 and out of the surround section 2510 at locations 2554.

Figure 25F:
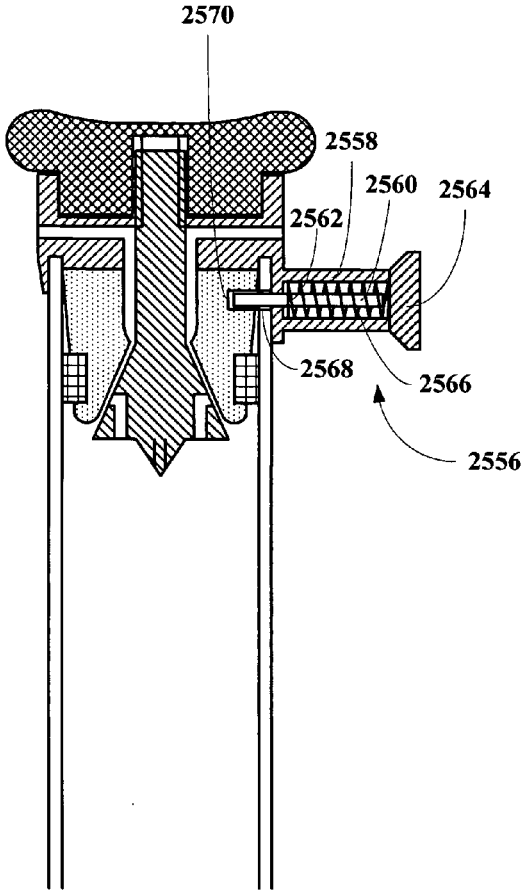
Figure 25G:
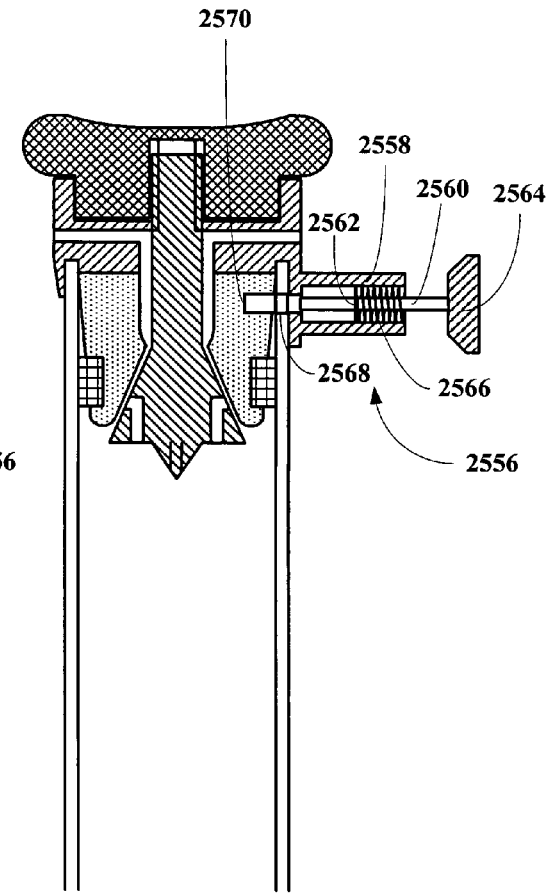

Referring now to FIGS. 25F&G, the barrel blocking apparatus 2500 is shown to include a secondary spring loaded locking assembly 2556 disposed on a side of the surrounding section 2510. The assembly 2556 includes a housing 2558, a shaft 2560 having a spring stop 2562 and a cap 2564. The housing 2558 also includes a spring 2566. The shaft 2560 is adapted to insert into an aperture 2568 in the barrel 2524 and extend into a receiving opening 2570 in the surrounding section 2510. The cap 2564 is adapted to allow the shaft 2560 be withdrawn from the barrel aperture 2568 to remove the apparatus 2500 before or after it has been unlocked. When placing the apparatus 2500 with the spring loaded assembly on a barrel, the cap 2564 is pulled to allow the apparatus to go over the barrel, then the spring will force the shaft into an appropriate barrel aperture. The secondary locking assembly acts as a secondary safeguard to ensure that inadvertently fired paintballs cannot exit the end of the barrel. FIG. 25A shows the assembly 2556 in its locked position, while FIG. 25B shows the assembly 2556 in its unlocked position.

Referring now to FIGS. 26A-D, another embodiment of barrel blocking apparatus of this invention, generally 2600, is shown. Looking at FIGS. 26A&B, the apparatus 2600 includes a barrel plug or insertion portion 2602 and an outer portion 2604. The insertion portion 2602 includes a center post 2606 attached to or mounted on a top section 2608 of the outer portion 2604. The outer portion 2604 also includes a surrounding section 2610. The top section 2608 is mounted in a groove 2612 in the surrounding section 2610 of the outer portion 2604, while the central post 2606 extends through an aperture 2614 in the surrounding section 2610.

Figure 26A:
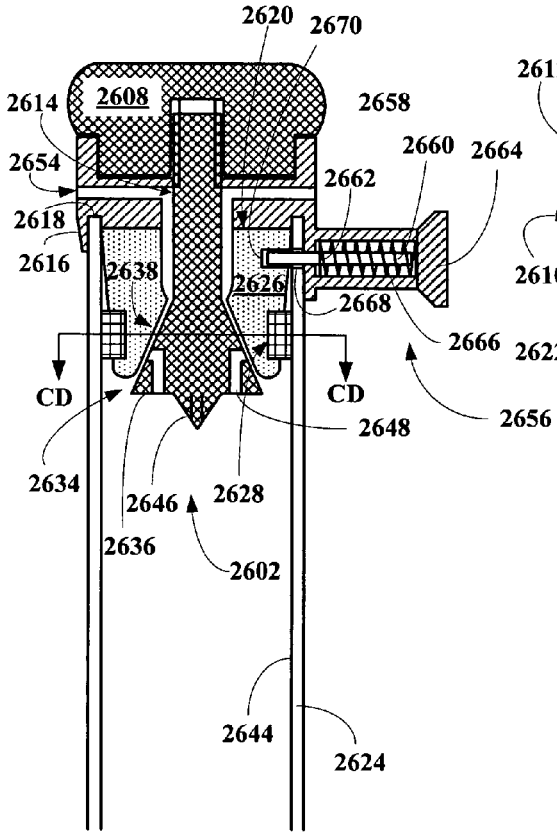
Figure 26B:
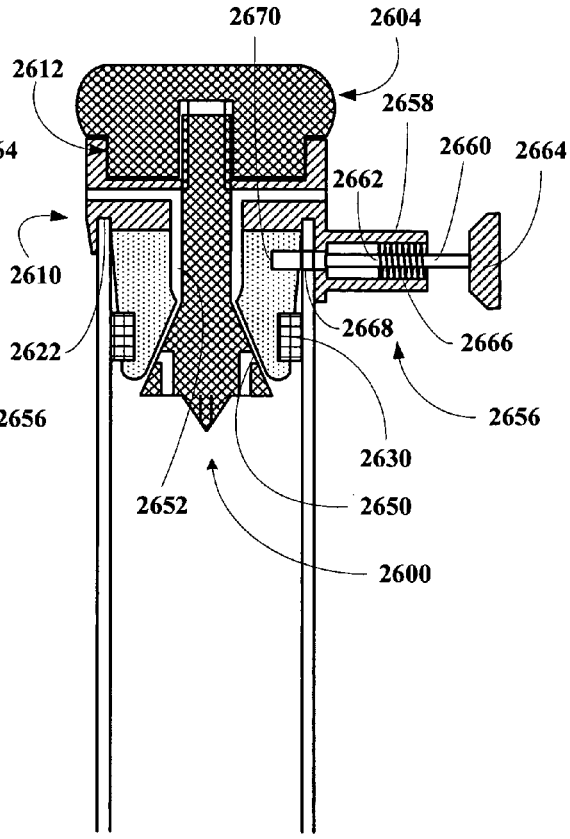
Figure 26C:
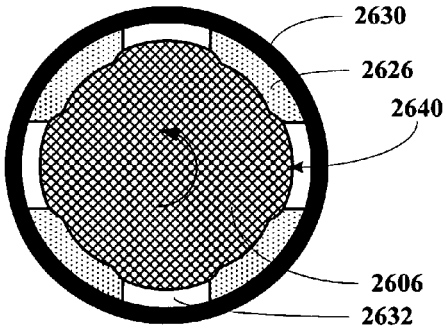
Figure 26D:
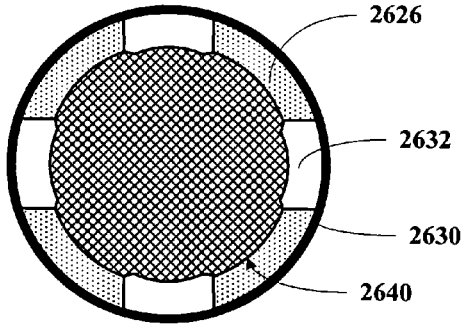
Figures 27A, 27B, 27C, 27D:
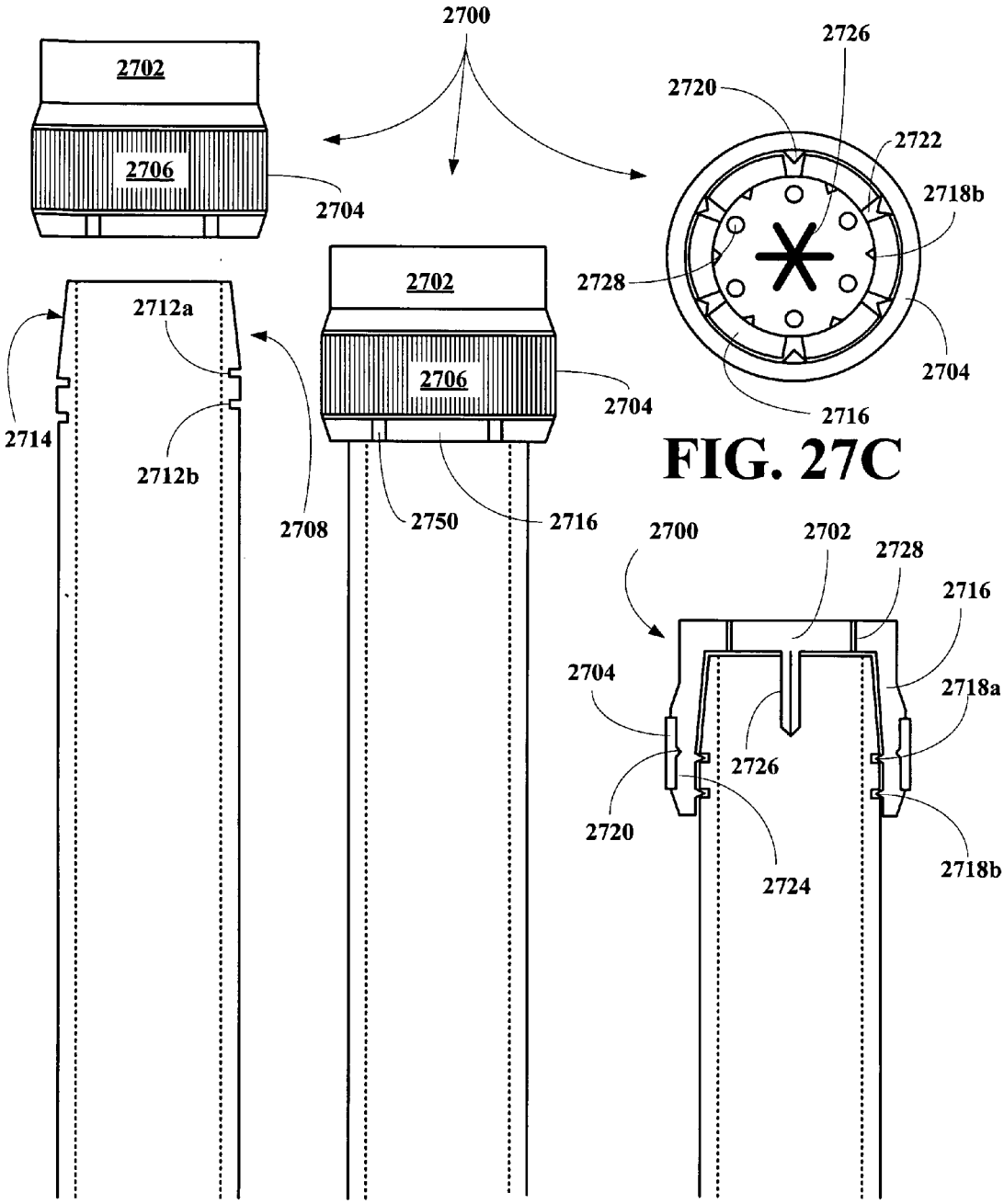

The surrounding section 2610 also includes an outer downwardly extending lip 2616 and a circular groove 2618 disposed on a lower surface 2620 of the surrounding section 2610 adjacent the lip 2616 and adapted to receive the end 2622 of the barrel 2624 of a paintball gun or other non-lethal gun. Extending from the lower surface 2620 of the surrounding section 2610 adjacent the groove 2618 are a plurality (four here) of prongs 2626 that form part of the insertion portion 2602. The prongs 2626 include grooves 2628 adapted to receive a friction ring (O-ring here) 2630. The prongs 2626 are spaced apart to form gaps 2632 therebetween as shown in FIGS. 26C and 26D.

The central post 2606 includes a flared portion 2634 near its distal end 2636. The prongs 2626 have inner surfaces 2638 conformed to the flared portion 2634 of the post 2606. In the flared portion 2634 of the post 2606 are raised sections 2640 as shown in FIGS. 26C and 26D, which are designed to be disposed in the gaps 2632 between the prongs 2626 when the apparatus 2600 is its unlocked state. The top section 2608 includes a winged shaped member 2642 adapted to be turned by a user so that the top section 2608 can be rotated relative to the surrounding section 2610. When the top section 2608 is rotated via the member 2642, the post 2606 also rotates. After about a quarter turn, the post 2606 rotates sufficient to engage the conforming surfaces 2638 of the prongs 2626 are pushed outward compressing the fiction ring 2630 forcing it against an inner surface 2644 of the barrel 2624 to frictionally lock the apparatus 2600 in place. This locking process is shown in the transitional FIGS. 26C and 26D (cut along the section line CD), which show the apparatus 2600 its unlocked state and in its locked state, respectively, showing the compression of the friction ring 2630.

The central post 2606 can also include a penetrator 2646 disposed in the distal end 2636 of the post 2606 and adapted to assist in rupturing paintball that are inadvertently fired from the gun. The post 2606 can also include vents 2648 in its distal end 2636 opening at locations 2650 in the flared section 2634 of the post 2606. The vents 2648 are blocked when the apparatus 2600 is in its unlocked state, but open into connecting conduits 2652 that extend up along the post 2606 and out of the surround section 2610 at locations 2654.

The barrel blocking apparatus 2600 can also include a secondary spring loaded locking assembly 2656 disposed on a side of the surrounding section 2610. The assembly 2656 includes a housing 2658, a shaft 2660 having a spring stop 2662 and a cap 2664. The housing 2658 also includes a spring 2666. The shaft 2660 is adapted to insert into an aperture 2668 in the barrel 2624 and extend into a receiving opening 2670 in the surrounding section 2610. The cap 2664 is adapted to allow the shaft 2660 be withdrawn from the barrel aperture 2668 to remove the apparatus 2600 before or after it has been unlocked. When placing the apparatus 2600 with the spring loaded assembly on a barrel, the cap 2664 is pulled to allow the apparatus to go over the barrel, then the spring will force the shaft into an appropriate barrel aperture. The secondary locking assembly acts as a secondary safeguard to ensure that inadvertently fired paintballs cannot exit the end of the barrel. FIG. 26A shows the assembly 2656 in its locked position, while FIG. 26B shows the assembly 2656 in its unlocked position.

Referring now to FIGS. 27A-*d*, another embodiment of barrel blocking apparatus of this invention, generally 2700, is shown. Looking at FIG. 27A, the apparatus 2700 includes a body 2702 and a rotatable ring 2704 having a gripping surface 2706. The apparatus 2700 is adapted to engages a grooved barrel end 2708 of a paintball barrel 2710. The grooved end 2708 includes two radial grooves 2712*a*&*b*. The grooved end 2708 also includes a tapered distal end 2714. Although two barrel grooves are shown and the barrel is tapered, the barrel end can be untapered and include only one groove or more than two grooves depending on design and style.

The body 2702 includes sis downwardly extending, spaced apart prongs 2716 having a first raised area 2718*a* adapted to engage the first barrel groove 2712*a*, and a second raised area 2718*b* adapted to engage the second barrel groove 2712*b*. The ring 2704 includes protrusions 2720 that are disposed to fit inside gaps 2722 between the prongs 2716 when the apparatus is in its unlocked state. Once rotated, the protrusions 2720 in the ring 2704 contact an outer surface 2724 of each prong 2716 forcing the raised areas 2718*a*&*b* into their aligned barrel grooves 2712*a*&*b*, respectively.

The body 2702 can also include a penetrator 2726 disposed on an inner surface 2736 of the body 2702 and adapted to assist in rupturing paintball that are inadvertently fired from the gun. The body 2702 can also include vents 2728 in therein adapt to vent paint and gases accompanying an inadvertently discharged and ruptured paintball.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

We claim:

1. A barrel blocking apparatus comprising:

an insertion portion including:

a top section, a central post attached to or mounted from an inner surface of the top section, where the central post includes:

a flared end, and raised areas, a surrounding section including:

a mounting groove in which the top section is mounted, a central aperture through which a narrow portion of the post passed through, a lip and an adjacent groove for engaging the end of the barrel of a paintball gun, a friction ring, a plurality of spaced apart prongs adjacent the groove and extending downward from a lower surface of the surrounding section, each prong including a groove adapted to receive the friction ring, where the top section and post are adapted to be rotated relative to the surrounding section an amount sufficient to force the raised areas of the post to engage conforming outer surfaces of the prongs and compress the frictional ring against the inner surface of the barrel with sufficient force to hold the apparatus in place and where the post is designed to apply greater force against the prongs and friction ring when struck by an inadvertently discharged paintball.

2. The apparatus of claim 1, wherein the post further includes vents and the surrounding section further includes conduits in gas communication with the vents when the apparatus is in a locked state.

3. The apparatus of claim 1, wherein the post further includes a spike.

4. The apparatus of claim 1, wherein the post further includes a spike and vents and the surrounding section further includes conduits in gas communication with the vents when the apparatus is in a locked state.

5. The apparatus of claim 1, further comprising a spring loaded secondary locking assembly designed to insert a retractable shaft into an aperture in the barrel when locked and to be unlocked by disengaging the shaft by pulling on a cap attached to the distal end of the assembly and where the assembly is attached to or integral with the surrounding section at a side thereof.

* * * * *